US009834000B2

(12) United States Patent
Koike et al.

(10) Patent No.: US 9,834,000 B2
(45) **Date of Patent: *Dec. 5, 2017**

(54) LIQUID STORAGE CONTAINER AND LIQUID JET APPARATUS

(71) Applicant: SEIKO EPSON CORPORATION, Tokyo (JP)

(72) Inventors: Yasunori Koike, Nagano (JP); Takashi Mano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 14 days.

This patent is subject to a terminal disclaimer.

(21) Appl. No.: 15/207,886

(22) Filed: Jul. 12, 2016

(65) Prior Publication Data

US 2016/0318307 A1 Nov. 3, 2016

Related U.S. Application Data

(63) Continuation of application No. 14/519,588, filed on Oct. 21, 2014, now Pat. No. 9,403,371.

(30) Foreign Application Priority Data

Oct. 23, 2013 (JP) ..... 2013-219889

(51) Int. Cl.
*B41J 2/175* (2006.01)

(52) U.S. Cl.
CPC ..... *B41J 2/17509* (2013.01); *B41J 2/17503* (2013.01); *B41J 2/17513* (2013.01)

(58) Field of Classification Search
None
See application file for complete search history.

(56) References Cited

U.S. PATENT DOCUMENTS

| | | | |
|---|---|---|---|
| 2008/0001995 | A1 | 1/2008 | Umeda |
| 2012/0038719 | A1 | 2/2012 | Shimizu et al. |
| 2012/0050359 | A1 | 3/2012 | Koganehira et al. |
| 2012/0182364 | A1 | 7/2012 | Takeda et al. |
| 2013/0169720 | A1 | 7/2013 | Nakamura et al. |

(Continued)

FOREIGN PATENT DOCUMENTS

| | | | |
|---|---|---|---|
| CN | 101096145 | A | 1/2008 |
| CN | 102336061 | A | 2/2012 |

(Continued)

*Primary Examiner* — An Do
*Assistant Examiner* — Renee I Wilson
(74) *Attorney, Agent, or Firm* — Global IP Counselors, LLP

(57) ABSTRACT

A liquid storage container includes a liquid storage section configured to store a liquid, a liquid injection section connected to the liquid storage section and configured to inject the liquid into the liquid storage section, an air chamber communicated with air, an air introduction section communicated to the air chamber and configured to introduce the air to the air chamber, a communicating passage through which the liquid storage section and the air chamber are communicated to each other, a liquid injection port defined as an intersection at which the liquid injection section and the liquid storage section intersect each other, and a connecting port defined between the liquid storage section and the communicating passage and located above the liquid injection port in a posture where the liquid injection port is oriented upward in a direction intersecting with a horizontal direction.

8 Claims, 22 Drawing Sheets

(56) References Cited

U.S. PATENT DOCUMENTS

| | | | |
|---|---|---|---|
| 2014/0146113 | A1 | 5/2014 | Shimizu et al. |
| 2015/0085030 | A1 | 3/2015 | Shimizu et al. |
| 2015/0343789 | A1 | 12/2015 | Shimizu et al. |

FOREIGN PATENT DOCUMENTS

| | | | |
|---|---|---|---|
| CN | 102582258 | A | 7/2012 |
| JP | 61-020332 | U | 2/1986 |
| JP | 2012-020495 | A | 2/2012 |
| JP | 2012-020496 | A | 2/2012 |
| JP | 2012-051307 | A | 3/2012 |
| JP | 2012-051308 | A | 3/2012 |
| JP | 2012-051309 | A | 3/2012 |
| JP | 2012-051328 | A | 3/2012 |
| JP | 2012-066563 | A | 4/2012 |
| JP | 2013-139140 | A | 7/2013 |

LIQUID STORAGE CONTAINER AND LIQUID JET APPARATUS

CROSS-REFERENCE TO RELATED APPLICATIONS

This is a continuation application of U.S. patent application Ser. No. 14/519,588 filed on Oct. 21, 2014. This application claims priority to Japanese Patent Application No. 2013-219889 filed on Oct. 23, 2013. The entire disclosures of U.S. patent application Ser. No. 14/519,588 and Japanese Patent Application No. 2013-219889 are hereby incorporated herein by reference.

BACKGROUND

Technical Field

The present invention relates to a liquid storage container and a liquid jet apparatus, inter alia.

Related Art

Inkjet printers have conventionally been known as one example of a liquid jet apparatus. In an inkjet printer, printing on a printing medium such as printing paper can be carried out by discharging an ink, which is one example of a liquid, from an ejection head onto the printing medium. With such an inkjet printer, there is a conventionally known configuration where ink that has been collected in a tank, which is one example of a liquid storage container, is supplied to the ejection head. An ink injection port is provided to this tank. A user is able to refill the tank with ink from the ink injection port. In such a tank, there is a conventionally known configuration with which a liquid storage chamber in which the ink is stored and an air storage chamber in which air is introduced are in communication with one another by a communicating section (see JP-A-2012-20495 (patent document 1), for example).

SUMMARY

In the tank described in patent document 1 above, even when, for example, the ink that is inside the liquid storage chamber flows out to the air storage chamber side via the communicating section, the ink that has flowed out to the air storage chamber side can still be collected in the air storage chamber. This tank therefore makes it easier to reduce leakage of the ink that is inside the liquid storage chamber to outside of the tank via the air release port. However, with the tank described above, in an injection posture at which the ink is injected into the liquid injection port, the liquid storage chamber-side opening of the communicating section is located below the liquid injection port and therefore the ink inside the liquid storage section readily flows into the communicating section. Then, when an external force such as vibration acts in a state where the ink has flowed into the communicating section, the ink inside the communicating section becomes more likely to flow into the air storage chamber. When the ink is more likely to flow into the air storage chamber, then there is an increased possibility that ink could leak out of the tank from the air release port. In this manner, a conventional liquid storage container has a problem in that it is difficult to reduce the possibility of leakage of the liquid from occurring.

The present invention has been made in order to solve the above-described problem at least in part, and can be realized in the form of the following modes or application examples.

A liquid storage container is characterized by comprising a liquid storage section configured to store a liquid, a liquid injection section configured to inject the liquid into the liquid storage section, an air chamber communicated with air, an air introduction section communicated to the air chamber and configured to introduce the air to the air chamber, a communicating passage through which the liquid storage section and the air chamber are communicated to each other, a liquid injection port defined as an intersection at which the liquid injection section and the liquid storage section intersect each other, and a connecting port defined between the liquid storage section and the communicating passage and located above the liquid injection port in a posture where the liquid injection port is oriented upward in a direction intersecting with a horizontal direction.

In the liquid storage container of this aspect, the connecting port between the liquid storage section and the communicating passage is located above the liquid injection port, and therefore the liquid inside the liquid storage section is less likely to reach the connecting port. For this reason, the possibility that the liquid inside the liquid storage section could flow into the communicating passage is reduced. As a result, the possibility that the liquid inside the liquid storage section could reach the air chamber is reduced, and therefore the possibility that the liquid inside the liquid storage section could leak out of the liquid storage container via the air introduction section from the air chamber can be reduced.

BRIEF DESCRIPTION OF THE DRAWINGS

Referring now to the attached drawings which form a part of this original disclosure.

DETAILED DESCRIPTION OF EMBODIMENTS

Embodiments shall be described below with reference to the accompanying drawings, using the example of an inkjet printer (hereinafter called a printer), which is one example of a liquid jet apparatus. In each of the drawings, there may be instances where the scales of the configurations and members have been altered in order to make the respective configurations large enough to be recognizable.

Figure 1:
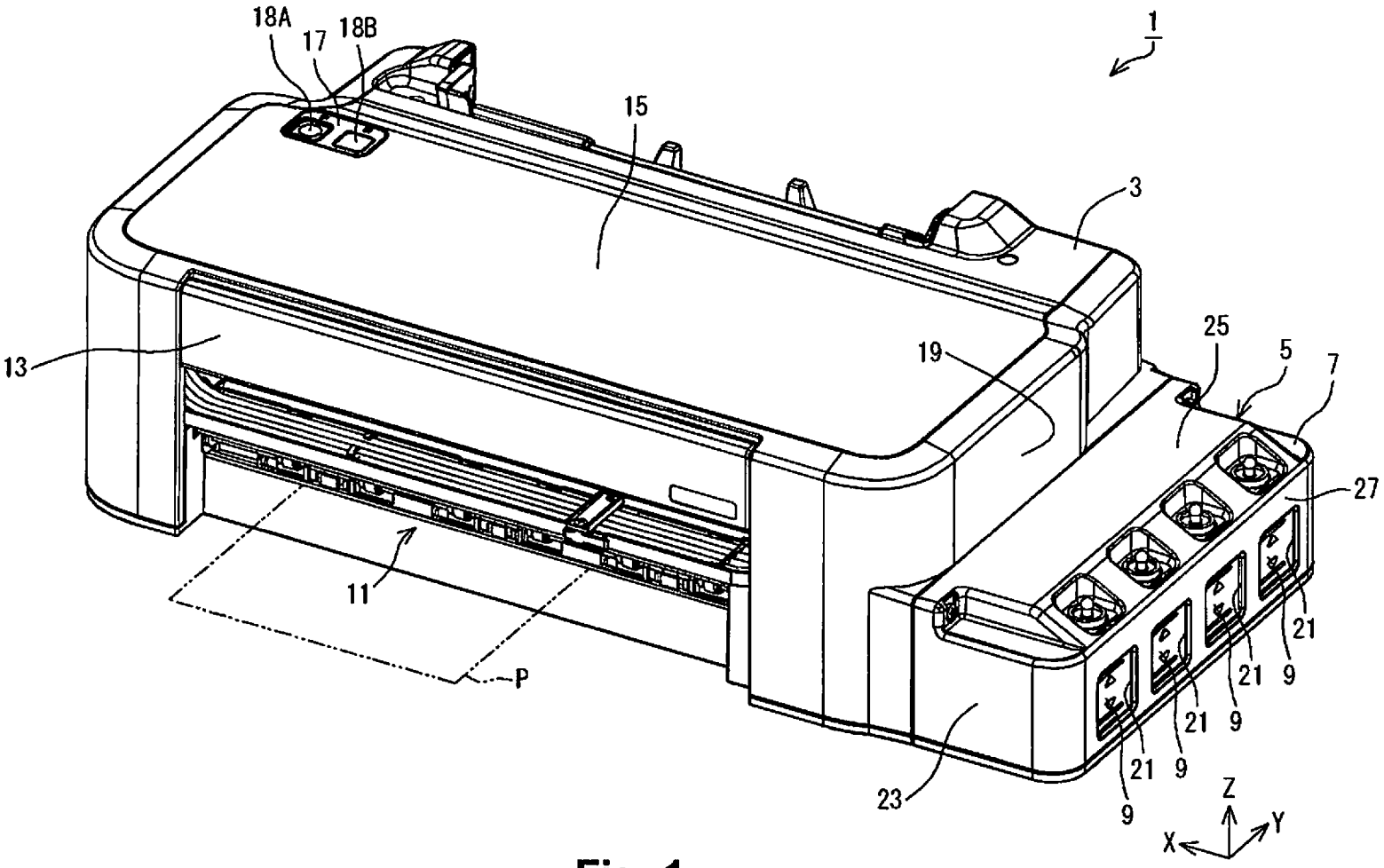
FIG. 1 is a perspective view illustrating a printer in the present embodiments.

A printer 1 in the present embodiments, as illustrated in FIG. 1, has a first case 3 and a tank unit 5. The printer 1 is able to print onto a printing medium P of printing paper or the like using ink, which is one example of a liquid. The tank unit 5 has a second case 7, which is one example of a case member, and a plurality of (two or more) tanks 9. The first case 3 and the second case 7 constitute an outer shell of the printer 1. Here, in FIG. 1, XYZ axes have been assigned, which are coordinate axes that are orthogonal to one another. XYZ axes have been assigned where necessary in the subsequently illustrated drawings, as well. In each of the XYZ axes, the orientation of the arrow illustrates the plus direction (forward direction), and the opposite orientation to the orientation of the arrow illustrates the minus direction (negative direction). In a state in which the printer 1 is used, the printer 1 is arranged on a horizontal plane that is defined by the X-axis direction and the Y-axis direction. In the state of use of the printer 1, the Z-axis direction is a direction orthogonal to the horizontal plane, and the −Z-axis direction is vertically downward.

Stored in the first case 3 is a mechanism unit 10 (FIG. 3) of the printer 1. The mechanism unit 10 is a mechanism portion for executing the operation of printing in the printer 1. A more detailed description of the mechanism unit 10 shall be provided below. The plurality of tanks 9 are stored inside the second case 7, as illustrated in FIG. 1, and each of the plurality of tanks 9 stores ink that is supplied for printing. In the present embodiments, there are four of the tanks 9 that are provided. In the four tanks 9, there is a different kind of ink for each of the tanks 9. In the present embodiments, the four kinds of ink that are employed are black, yellow, magenta, and cyan. One of each is provided—a tank 9 that stores the black ink, a tank 9 that stores the yellow ink, a tank 9 that stores the magenta ink, and a tank 9 that stores the cyan ink. In the printer 1, the plurality of tanks 9 are provided to the outside of the first case 3. For this reason, in the printer 1, the plurality of tanks 9 are not built into the first case 3, which covers the mechanism unit 10.

Also provided to the printer 1 is a paper discharge section 11. In the printer 1, the printing medium P is discharged from the paper discharge section 11. In the printer 1, a surface to which the paper discharge section 11 is provided is understood to be a front surface 13. The printer 1 also has an operation panel 17 at an upper surface 15 that intersects the front surface 13. Provided to the operation panel 17 are a power button 18A, another operation button 18B, and the like. The tank unit 5 is provided to a side section 19 that intersects the front surface 13 and the upper surface 15 in the first case 3. Window sections 21 are provided to the second case 7. The window sections 21 are provided to a side section 27 that intersects with a front surface 23 and an upper surface 25 in the second case 7. The window sections 21 are optically transparent. The four tanks 9 described above are provided to positions overlapping with the window sections 21. For this reason, a worker who is using the printer 1 is able to view the four tanks 9 through the window sections 21.

Figure 2:
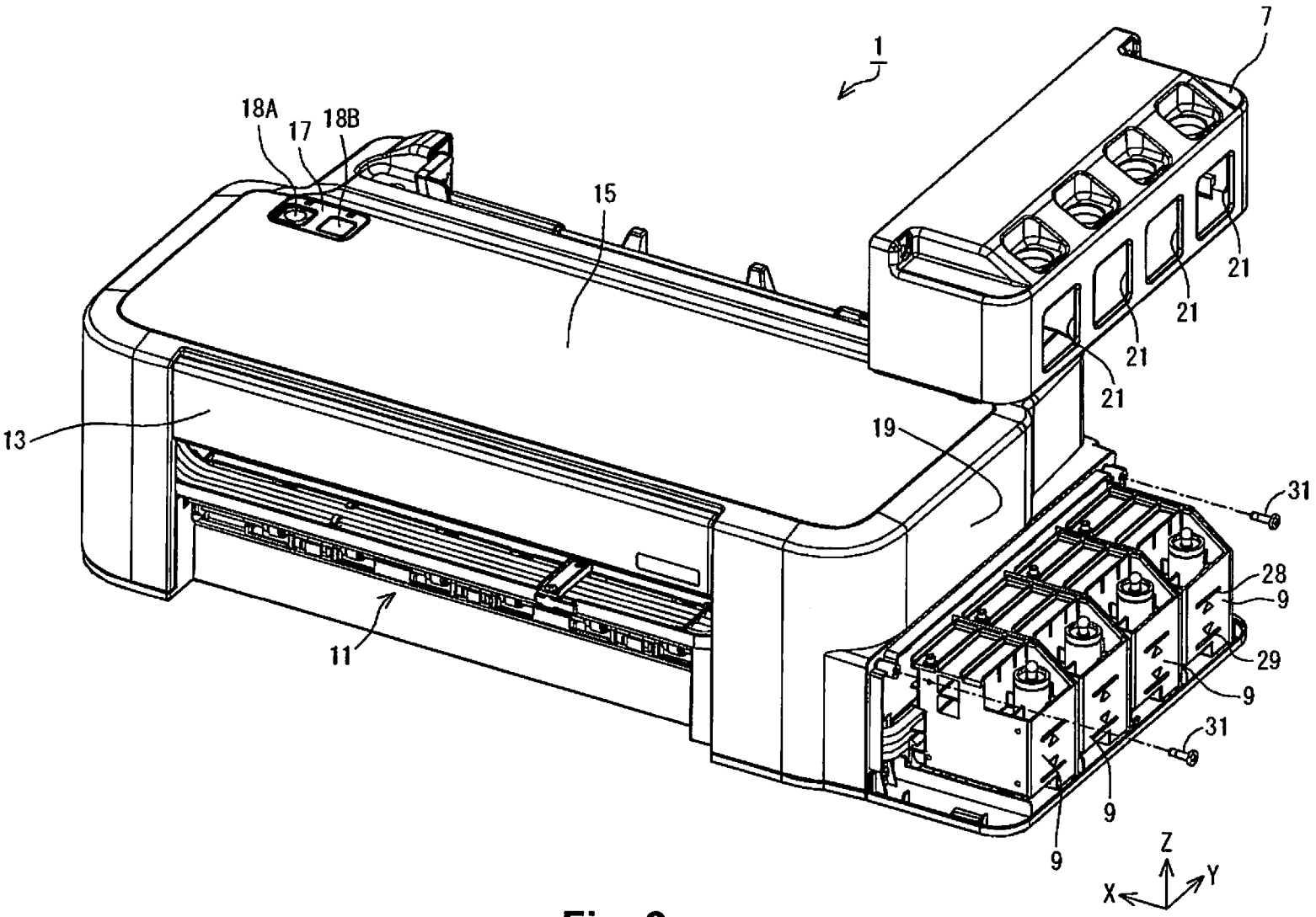
FIG. 2 is a perspective view illustrating a printer in the present embodiments.

In the present embodiments, the sites of each of the tanks 9 that face the window sections 21 are optically transparent. The inks inside the tanks 9 can be viewed from the optically transparent sites of each of the tanks 9. As such, viewing the four tanks 9 via the window sections 21 allows the worker to view the amount of ink that is in each of the tanks 9. Provided to each of the tanks 9, to the sites that face the window sections 21, are an upper limit mark 28 indicative of an upper limit for the amount of ink and a lower limit mark 29 indicative of a lower limit for the amount of ink. The worker can use the upper limit marks 28 and the lower limit marks 29 as benchmarks to ascertain the amount of ink that is in each of the tanks 9. Meanwhile, the first case 3 and the second case 7 are constituted of separate bodies from one another. For this reason, in the present embodiments, the second case 7 can be separated from the first case 3, as illustrated in FIG. 2. The second case 7 is coupled to the first case 3 by mounting screws 31. Also, as illustrated in FIG. 2, the second case 7 at least partially covers the four (two or more) tanks 9, such as with, for example, the front surfaces, upper surfaces, and side surfaces thereof.

Figure 3:
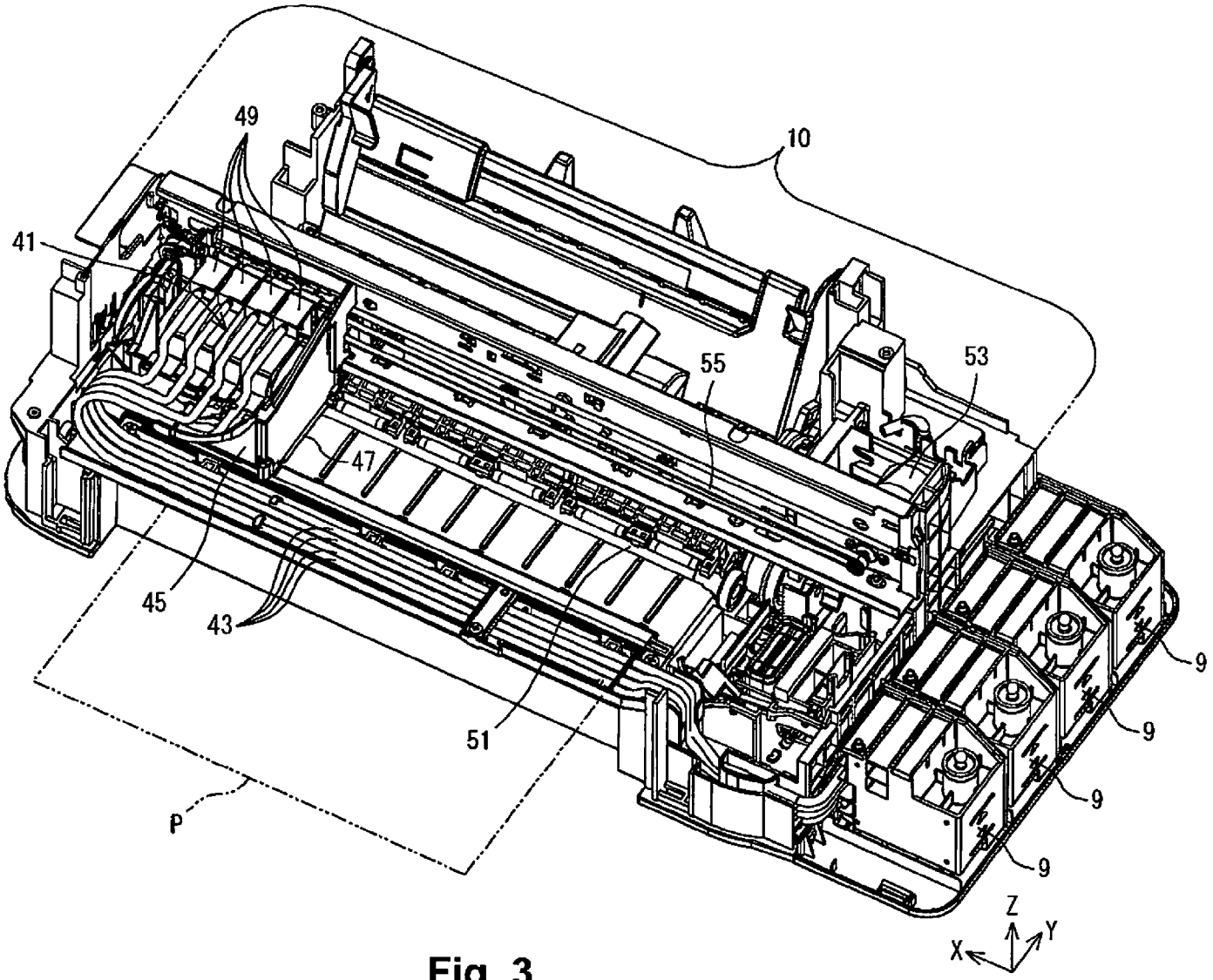
FIG. 3 is a perspective view illustrating a mechanism unit of a printer in the present embodiments.

The printer 1 has a print section 41 and supply tubes 43, as illustrated in FIG. 3, which is a perspective view illustrating the mechanism unit 10. The print section 41 has a carriage 45, a print head 47, and four relay units 49. The print head 47 is mounted onto the carriage 45, as are the relay units 49. The supply tubes 43 are flexible and are provided between the tanks 9 and the relay units 49. The inks inside the tanks 9 are sent to the relay units 49 via the supply tubes 43. The relay units 49 relay to the print head 47 the inks that are supplied from the tanks 9 via the supply tubes 43. The print head 47 discharges the supplied inks as ink droplets.

The printer 1 also has a medium conveyance mechanism (not shown) and a head conveyance mechanism (not shown). The medium conveyance mechanism conveys the printing medium P along the Y-axis direction by driving a conveyance roller 51 using power coming from a motor (not shown). The head conveyance mechanism conveys the carriage 45 along the X-axis direction by transmitting power coming from a motor 53 to the carriage 45 via a timing belt 55. The print head 47 is mounted onto the carriage 45. For this reason, the print head 47 can be conveyed in the X-axis direction via the carriage 45, by the head conveyance mechanism. The print head 47 is supported by the carriage 45 in a state of facing the printing medium P. The inks are discharged from the print head 47 while the relative position of the print head 47 with respect to the printing medium P is being changed by the medium conveyance mechanism and the head conveyance mechanism, whereby printing is performed on the printing medium P.

Various embodiments of the tanks 9 shall be described. For the purpose of discriminating between the different embodiments of the tanks 9 below, a different alphabetic character for each of the embodiments shall be appended to the reference numeral for the tanks 9.

(First Embodiment)

Figure 4:
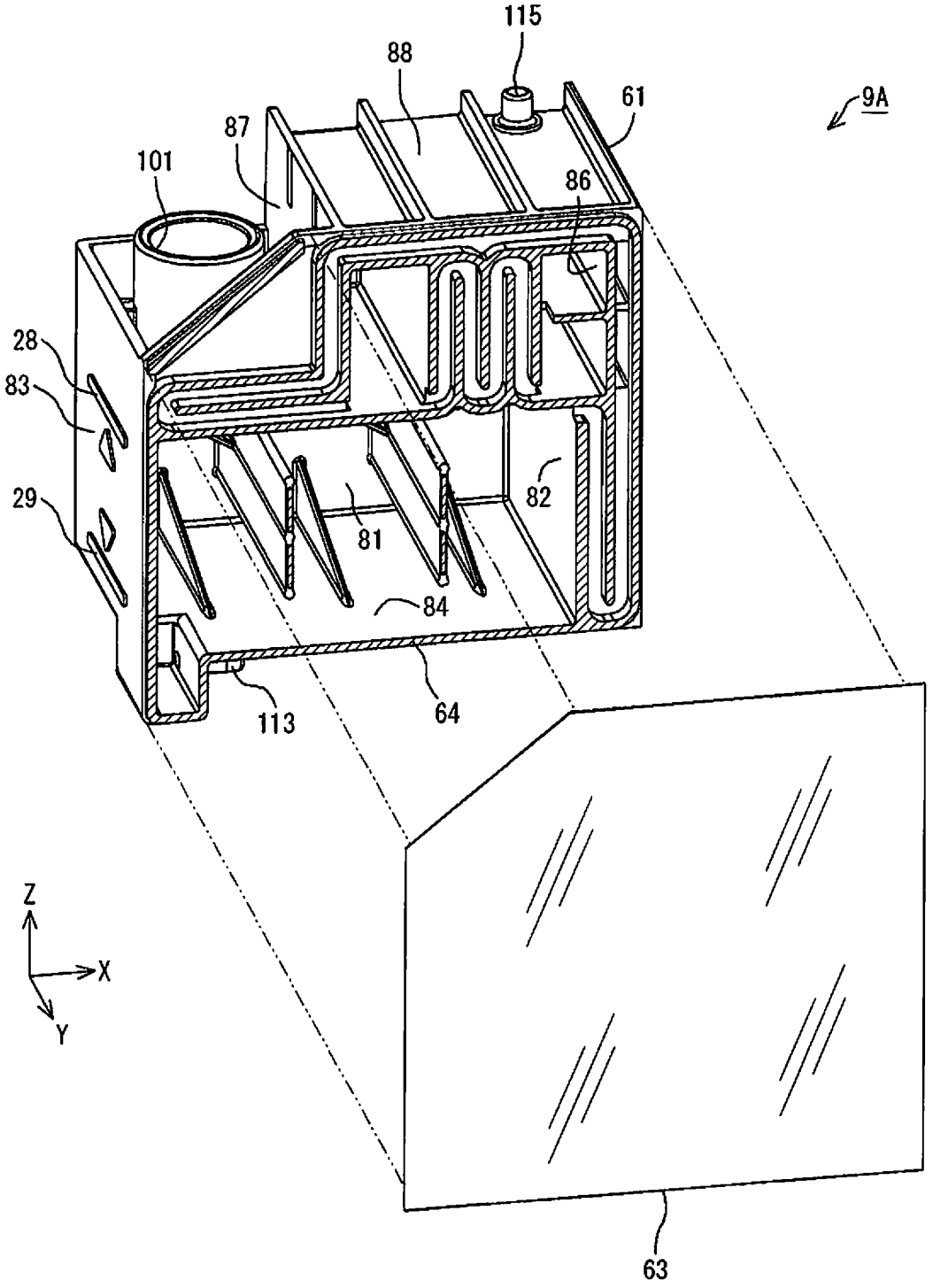
FIG. 4 is an exploded perspective view illustrating a tank in a first embodiment.

A tank 9A as in the first embodiment shall now be described. The tank 9A, as illustrated in FIG. 4, has a case 61, which is one example of a tank main body, and a sheet member 63. The case 61 is constituted of, for example, a synthetic resin such as nylon or polypropylene. The sheet member 63 is formed of a synthetic resin (for example, nylon, polypropylene, or the like) in the shape of a film and is flexible. In the present embodiment, the sheet member 63 is optically transparent. The tank 9A has a configuration with which the case 61 and the sheet member 63 are bonded together. Bonding sections 64 are provided to the case 61. FIG. 4 depicts the bonding sections 64 with hatching in order to better illustrate the configuration. The sheet member 63 is bonded to the bonding sections 64 of the case 61. In the present embodiment, the case 61 and the sheet member 63 are bonded together by welding.

Figure 5:
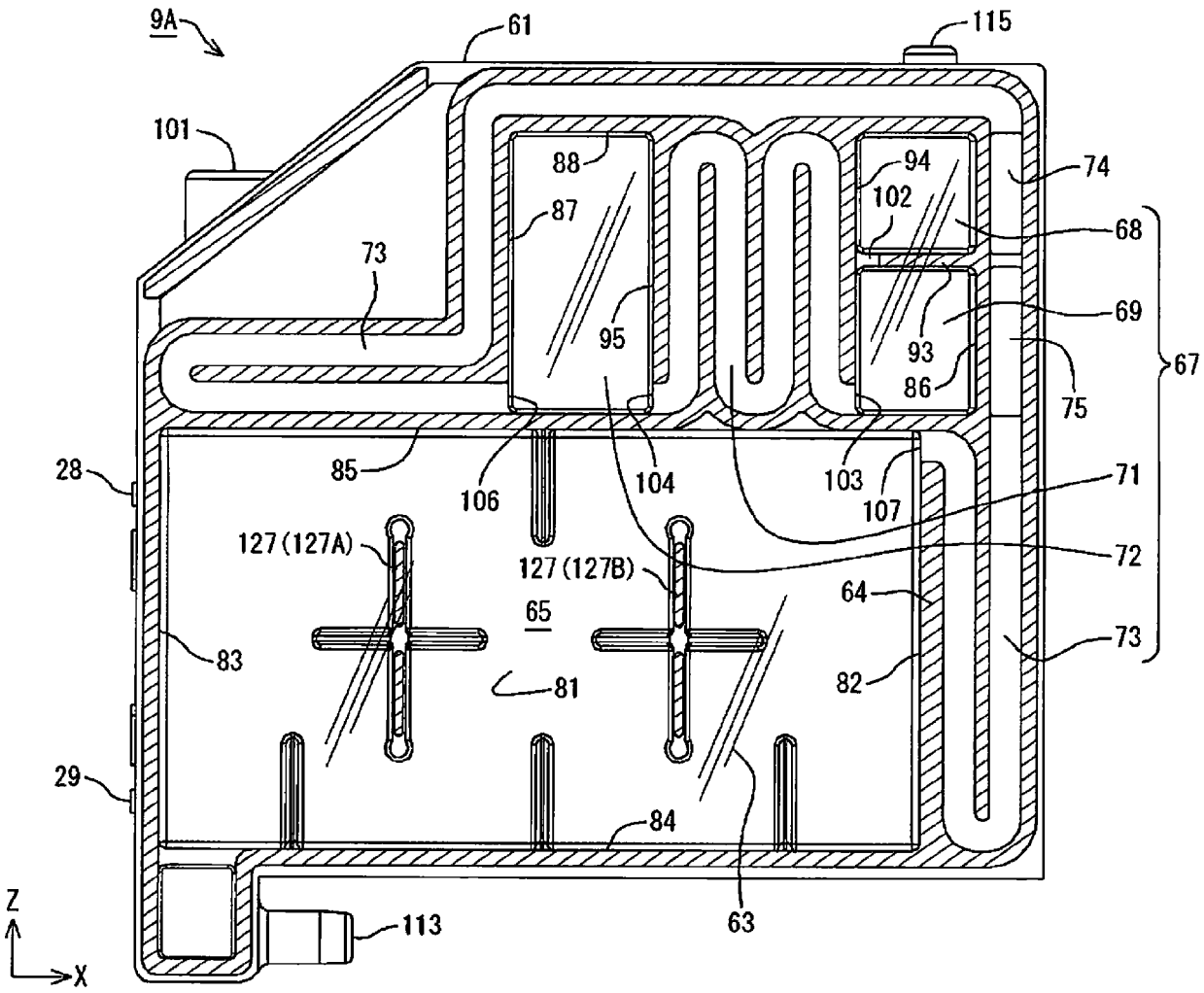
FIG. 5 is a side view of when a tank in the first embodiment is viewed from a sheet member side.

The tank 9A, as illustrated in FIG. 5, has a storage section 65 and a communicating section 67. The communicating section 67 has a first air chamber 68, a second air chamber 69, a first communicating passage 71, a third air chamber 72, a second communicating passage 73, a first buffer chamber 74, and a second buffer chamber 75. In the tank 9A, the ink is stored inside the storage section 65. FIG. 5 illustrates a state where the tank 9A is viewed from the sheet member 63 side, and depicts the case 61 with the sheet member 63 in between. The storage section 65, the first air chamber 68, the second air chamber 69, the first communicating passage 71, the third air chamber 72, and the second communicating passage 73 are partitioned from one another by the bonding sections 64. The first buffer chamber 74 and the second buffer chamber 75 are each provided to inside the second communicating passage 73.

The case 61 has a first wall 81, a second wall 82, a third wall 83, a fourth wall 84, a fifth wall 85, a sixth wall 86, a seventh wall 87, and an eighth wall 88. Arranged on the side of the fifth wall 85 opposite to the storage section 65 side are the first air chamber 68, the second air chamber 69, the first communicating passage 71, and the third air chamber 72. When the first wall 81 is seen in plan view from the sheet member 63 side, then the storage section 65 is surrounded by the second wall 82, the third wall 83, the fourth wall 84, and the fifth wall 85.

When the first wall 81 is seen in plan view from the sheet member 63 side, then the first air chamber 68, the second air chamber 69, the first communicating passage 71, and the third air chamber 72 are surrounded by the fifth wall 85, the sixth wall 86, the seventh wall 87, and the eighth wall 88. The first wall 81 of the storage section 65 and the first wall 81 of the first air chamber 68, the second air chamber 69, and the third air chamber 72 are the same wall as one another. In other words, in the present embodiment, the first wall 81 is shared among the storage section 65, the first air chamber 68, the second air chamber 69, and the third air chamber 72.

Figure 6:
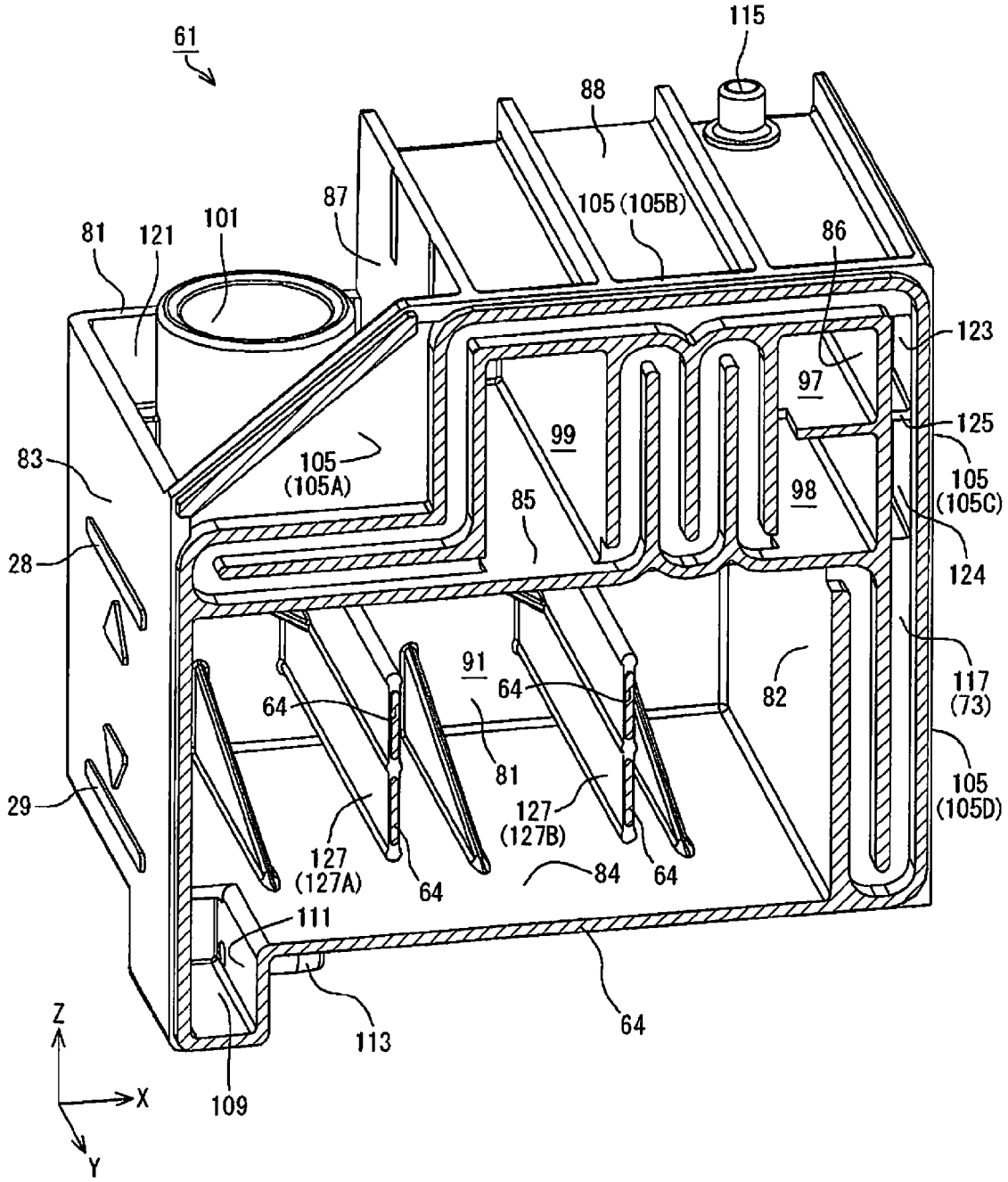
FIG. 6 is a perspective view illustrating a case in the first embodiment.

The second wall 82, the third wall 83, the fourth wall 84, and the fifth wall 85 each intersect the first wall 81, as illustrated in FIG. 6. The second wall 82 and the third wall 83 are provided to positions that face each other across the first wall 81 in the X-axis direction. The fourth wall 84 and the fifth wall 85 are provided to positions that face each other across the first wall 81 in the Z-axis direction. The second wall 82 intersects with each of the fourth wall 84 and the fifth wall 85. The third wall 83 also intersects with each of the fourth wall 84 and the fifth wall 85.

The second wall 82, the third wall 83, the fourth wall 84, and the fifth wall 85 project out in the +Y-axis direction from the first wall 81. Due to this, where the first wall 81 is a main wall, a recess 91 is constituted of the second wall 82, the third wall 83, the fourth wall 84, and the fifth wall 85, which extend in the +Y-axis direction from the main wall. The recess 91 is configured with an orientation so as to be concave going towards the −Y-axis direction. The recess 91 forms an opening going toward the +Y-axis direction, i.e., toward the sheet member 63 (FIG. 4) side. In other words, the recess 91 is provided at an orientation so as to be concave going toward the −Y-axis direction, i.e., toward the side opposite to the sheet member 63 (FIG. 4) side. When the sheet member 63 is bonded to the case 61, the recess 91 is closed off by the sheet member 63, thus constituting the storage section 65. The first wall 81 through the eighth wall 88 each are not limited to being flat walls, and may also be ones that comprise irregularities.

The sixth wall 86 projects out from the fifth wall 85 toward the side of the fifth wall 85 opposite to the fourth wall 84 side, i.e., toward the +Z-axis direction side of the fifth wall 85, as illustrated in FIG. 5. The seventh wall 87 projects out from the fifth wall 85 toward the side of the fifth wall 85 opposite to the fourth wall 84 side, i.e., toward the +Z-axis direction side of the fifth wall 85. The sixth wall 86 and the seventh wall 87 are provided to positions that face each other across the first air chamber 68, the second air chamber 69, the first communicating passage 71, and the third air chamber 72 in the X-axis direction. The eighth wall 88 is provided to a position that faces the fifth wall 85 across the first air chamber 68, the second air chamber 69, the first communicating passage 71, and the third air chamber 72 in the Z-axis direction. The sixth wall 86 intersects with each of the fifth wall 85 and the eighth wall 88. The seventh wall 87 also intersects with each of the fifth wall 85 and the eighth wall 88.

Provided between the fifth wall 85 and the eighth wall 88 is a ninth wall 93 by which the first air chamber 68 and the second air chamber 69 are partitioned in the Z-axis direction. Also, provided between the sixth wall 86 and the seventh wall 87 are a tenth wall 94 and an eleventh wall 95. Between the first air chamber 68 and second air chamber 69 and the third air chamber 72, a separation in the X-axis direction is formed by the tenth wall 94 and the eleventh wall 95. The tenth wall 94 is provided to the seventh wall 87 side more than the sixth wall 86, and faces the sixth wall 86. The eleventh wall 95 is provided to the sixth wall 86 side more than the seventh wall 87, and faces the seventh wall 87. The eleventh wall 95 is provided to the seventh wall 87 side more than the tenth wall 94.

The sixth wall 86, the seventh wall 87, the eighth wall 88, the ninth wall 93, the tenth wall 94, and the eleventh wall 95 each project out in the +Y-axis direction from the first wall 81, as illustrated in FIG. 6. The sixth wall 86, the ninth wall 93, the tenth wall 94, and the eighth wall 88, which extend in the +Y-axis direction from the first wall 81, together constitute a recess 97. The sixth wall 86, the fifth wall 85, the tenth wall 94, and the ninth wall 93, which extend in the +Y-axis direction from the first wall 81, together constitute a recess 98. The fifth wall 85, the seventh wall 87, the eighth wall 88, and the eleventh wall 95, which extend in the +Y-axis direction from the first wall 81, together constitute a recess 99.

The recess 97, the recess 98, and the recess 99 each form an opening going toward the +Y-axis direction, i.e., toward the sheet member 63 (FIG. 4) side. In other words, the recess 97, the recess 98, and the recess 99 are provided at an orientation so as to be concave going toward the −Y-axis direction, i.e., toward the side opposite to the sheet member 63 (FIG. 4) side. Then, when the sheet member 63 is bonded to the case 61, the recess 97 is closed off by the sheet member 63, thus constituting the first air chamber 68. Likewise, when the sheet member 63 is bonded to the case 61, the recess 98 is closed off by the sheet member 63, thus constituting the second air chamber 69, and the recess 99 is closed off by the sheet member 63, thus constituting the third air chamber 72. The amounts by which the second wall 82 through eighth wall 88 and the ninth wall 93 through eleventh wall 95 project out from the first wall 81 are set so as to be the same amount of projection to one another.

The second wall 82 and the sixth wall 86 have a stepped difference in the X-axis direction. The second wall 82 is located to the third wall 83 side more than the sixth wall 86, i.e., to the −X-axis direction side more than the sixth wall 86. The third wall 83 and the seventh wall 87 have a stepped difference in the X-axis direction. The seventh wall 87 is located to the second wall 82 side more than the third wall 83, i.e., to the +X-axis direction side more than the third wall 83. An ink injection section 101 is provided between the third wall 83 and the seventh wall 87 in the state where the first wall 81 is seen in plan view from the sheet member 63 side. The ink injection section 101 is provided to the fifth wall 85.

The first communicating passage 71 is provided between the tenth wall 94 and the eleventh wall 95, as illustrated in FIG. 5, and forms communication between the second air chamber 69 and the third air chamber 72. The second communicating passage 73 is provided to the outside of the storage section 65, the first air chamber 68, the second air chamber 69, the first communicating passage 71, and the third air chamber 72. The second communicating passage 73 forms communication between the third air chamber 72 and the storage section 65. A communication port 102 is provided to the ninth wall 93. The first air chamber 68 and the second air chamber 69 are in communication with one another via the communication port 102. The second air chamber 69 is communicated to the first communicating passage 71 via a communication port 103. Also, the third air chamber 72 is communicated to the first communicating passage 71 via a communication port 104. The first communicating passage 71 is meandering. The second air chamber 69 is communicated to the third air chamber 72 after meandering the first communicating passage 71.

As illustrated in FIG. 6, an extended section 105 is provided to the case 61. The second communicating passage 73 is provided to the extended section 105. The extended section 105 has a site 105A that is extended out toward the +X-axis direction side from the fifth wall 85 along the edge of the opening of the recess 91, in a region of the fifth wall 85 that is to the −X-axis direction side more than the seventh wall 87. The site 105A is also extended out toward the −X-axis direction side from the seventh wall 87 along the edge of the opening of the recess 99 in the seventh wall 87. The extended section 105 furthermore has a site 105B that is extended out toward the +Z-axis direction side from the eighth wall 88. The extended section 105 moreover has a site 105C that is extended out toward the +X-axis direction side from the sixth wall 86 along the edge of the openings of the recess 97 and the recess 98 in the sixth wall 86. The extended section 105 additionally has a site 105D that is extended out toward the +X-axis direction side from the second wall 82 along the edge of the opening of the recess 91 in the second wall 82. The second communicating passage 73 is configured as a groove 117 that is provided to the extended section 105 at an orientation so as to be concave going toward the side opposite to the sheet member 63 side.

Here, inside the recess 91, a recess 109 is provided. The recess 109 is provided at an orientation so as to be concave going toward the opposite side to the fifth wall 85 side more than the fourth wall 84, i.e., going toward the −Z-axis direction side more than the fourth wall 84. Then, in the recess 109, a supply port 113 is provided to a wall 111 that faces the third wall 83 and the second wall 82. For this reason, the supply port 113 is provided between the third wall 83 and the second wall 82 in a state where the first wall 81 is seen in plan view. The ink injection section 101 and the supply port 113 each form communication between the outside of the case 61 and the inside of the recess 91. The supply port 113 projects out toward the second wall 82 side along the X-axis direction from the wall 111.

Also, an air communication port 115 is provided to the eighth wall 88. The air communication port 115 projects out from the eighth wall 88 to the side of the eighth wall 88 opposite to the fifth wall 85, i.e., to the +Z-axis direction side of the eighth wall 88. The air communication port 115 is provided to a position that overlaps with the recess 97 when the eighth wall 88 is seen in plan view, i.e., when the eighth wall 88 is seen in plan view in the XY plane. The air communication port 115 forms communication between the outside of the case 61 and the inside of the recess 97. The air communication port 115 is a communicating passage for air, in order to introduce the air that is outside of the case 61 to the inside of the recess 97. In the case 61, the bonding sections 64 are provided along the respective contours of each of the recess 91, the recess 97, the recess 98, the recess 99, the recess 109, the first communicating passage 71, and the second communicating passage 73.

The sheet member 63 faces the first wall 81 across the second wall 82 through eighth wall 88 in the Y-axis direction, as illustrated in FIG. 4. The sheet member 63 has a size that covers the recess 91, the recess 97, the recess 98, the recess 99, the recess 109, and the extended section 105, as seen in plan view. The sheet member 63 is welded to the bonding sections 64 in a state where there is a gap with the first wall 81 on the other side. This causes the recess 91, the recess 97, the recess 98, the recess 99, the recess 109, the first communicating passage 71, and the second communicating passage 73 to be sealed off by the sheet member 63. For this reason, the sheet member 63 can be regarded also as a covering for the case 61.

The second communicating passage 73 has a communication port 106 and a communication port 107, as illustrated in FIG. 5. The communication port 106 is an opening that opens toward the inside of the third air chamber 72. The communication port 107 is an opening that opens toward the inside of the storage section 65. The third air chamber 72 passes from the communication port 106 via the second communicating passage 73 through the communication port 107 to the storage section 65. By the above, the storage section 65 passes via the second communicating passage 73, the third air chamber 72, the first communicating passage 71, the second air chamber 69, the first air chamber 68, and the air communication port 115 to the exterior of the tank 9A. This means that the communicating section 67 establishes communication between the air communication port 115 and the storage section 65. Air that has flowed in to inside the first air chamber 68 from the air communication port 115 flows in to the second air chamber 69 via the communication port 102. Air that has flowed in to the second air chamber 69 flows in to the third air chamber 72 via the first communicating passage 71. Then, the air that has flowed in to the third air chamber 72 flows in to the inside of the storage section 65 via the second communicating passage 73.

The ink injection section 101 is provided to the fifth wall 85. The ink injection section 101 is provided to inside a recess 121 that is surrounded by the seventh wall 87, the extended section 105, the third wall 83, and the first wall 81, as illustrated in FIG. 6. As stated earlier, the extended section 105 projects out to the eighth wall 88 side more than the fifth wall 85. The seventh wall 87 also projects out to the eighth wall 88 side more than the fifth wall 85. Likewise, in the present embodiment, the first wall 81 and the third wall 83 each project out to the eighth wall 88 side more than the fifth wall 85. Then, the extended section 105 intersects with both the seventh wall 87 and the third wall 83. The first wall 81 also intersects with both the third wall 83 and the seventh wall 87. For this reason, a region of the fifth wall 85 that is on the third wall 83 side more than the seventh wall 87 constitutes the recess 121, which is surrounded by the seventh wall 87, the extended section 105, the third wall 83, and the first wall 81. The recess 121 is provided at an orientation so as to be concave going toward the fourth wall 84 side from the fifth wall 85 side.

Due to the configuration described above, the ink injection section 101 is surrounded by the seventh wall 87, the extended section 105, the third wall 83, and the first wall 81. In other words, the ink injection section 101 is provided to a region of the fifth wall 85 that is surrounded by the seventh wall 87, the extended section 105, the third wall 83, and the first wall 81. Then, the recess 121 has the function of an ink receiving section. The ink receiving section can receive, for example, ink that overflows from the ink injection section 101, or ink that has dripped down during injection. In this manner, the recess 121 has a function as an ink receiving section for receiving the ink.

In the case 61, a recess 123 is provided to the side of the sixth wall 86 opposite to the recess 97 side. The recess 123 and the recess 97 are lined up sandwiching the sixth wall 86 in the X-axis direction. Also, in the case 61, a recess 124 is provided to the side of the sixth wall 86 opposite to the recess 98 side. The recess 124 and the recess 98 are lined up sandwiching the sixth wall 86 in the X-axis direction. The recess 123 and the recess 124 are each provided at an orientation so as to be concave going toward the side opposite to the sheet member 63 (FIG. 4) side. The recess 123 and the recess 124 are both provided to inside the groove 117, and are lined up sandwiching a twelfth wall 125 in the Z-axis direction. The recess 123 and the recess 124 can each also be regarded as being configurations with which the depth at a part of the groove 117 is increased.

When the sheet member 63 is bonded to the case 61, the groove 117 is closed off by the sheet member 63, thus constituting the second communicating passage 73, as illustrated in FIG. 5. Then, in the second communicating passage 73, the recess 123 is configured as the first buffer chamber 74 and the recess 124 is configured as the second buffer chamber 75. Herein, as stated above, the recess 123 and the recess 124 can each also be regarded as being configurations with which the depth at a part of the groove 117 is increased. For this reason, the first buffer chamber 74 and the second buffer chamber 75 can also be regarded as being configurations with which the depth at a part of the second communicating passage 73 is increased. Accordingly, the respective cross-sectional areas of the first buffer chamber 74 and the second buffer chamber 75 in the horizontal plane (XY plane) are wider than the cross-sectional area of the second communicating passage 73 in the horizontal plane (XY plane). The respective cross-sectional areas of the first buffer chamber 74 and the second buffer chamber 75 in the horizontal plane (XY plane) are narrower than the cross-sectional area of the third air chamber 72 in the horizontal plane (XY plane). Thus, the respective volumes of the first buffer chamber 74 and the second buffer chamber 75 are smaller than the volume of the third air chamber 72.

Provided to inside the storage section 65 are a plurality of support sections 127, as illustrated in FIG. 5. In the present embodiment, there are two support sections 127 provided. Below, in cases where a distinction is being made between the two support sections 127, then the two support sections 127 shall be denoted by a support section 127A and a support section 127B. The two support sections 127 are lined up in the X-axis direction. Of the two support sections 127, the support section 127A is located to the third wall 83 side more than the support section 127B. The two support sections 127 are each spaced apart from each of the second wall 82, the third wall 83, the fourth wall 84, and the fifth wall 85. In the present embodiment, the gap between the third wall 83 and the support section 127A, the gap between the support section 127A and the support section 127B, and the gap between the second wall 82 and the support section 127B are set so as to be equal to one another. According to this configuration, deformations of the sheet member 63 can be equally regulated between the third wall 83 and the support section 127A, between the support section 127A and the support section 127B, and between the second wall 82 and the support section 127B. In a configuration where there is one support section 127 provided, then the gap between the third wall 83 and the support section 127 and the gap between the second wall 82 and the support section 127 are set so as to be equal to one another. This makes it possible to equally regulate deformations of the sheet member 63 between the third wall 83 and the support section 127 and between the second wall 82 and the support section 127.

The two support sections 127 are provided to the first wall 81 as illustrated in FIG. 6, and project out from the first wall 81 toward the sheet member 63 (FIG. 4) side, i.e., toward the +Y-axis direction side. Each of the two support sections 127 presents with a planar shape that extends along the YZ plane. The amount by which the two support sections 172 project out from the first wall 81 is set so as to be equal to the amounts by which the second wall 82 through fifth wall 85 project out from the first wall 81. At each of the two support sections 127, the bonding sections 64 are provided to an end section of the side opposite to the first wall 81 side, i.e., of the sheet member 63 (FIG. 4) side. The sheet member 63 is also bonded to the bonding sections 64 at each of the two support sections 127.

Figure 7:
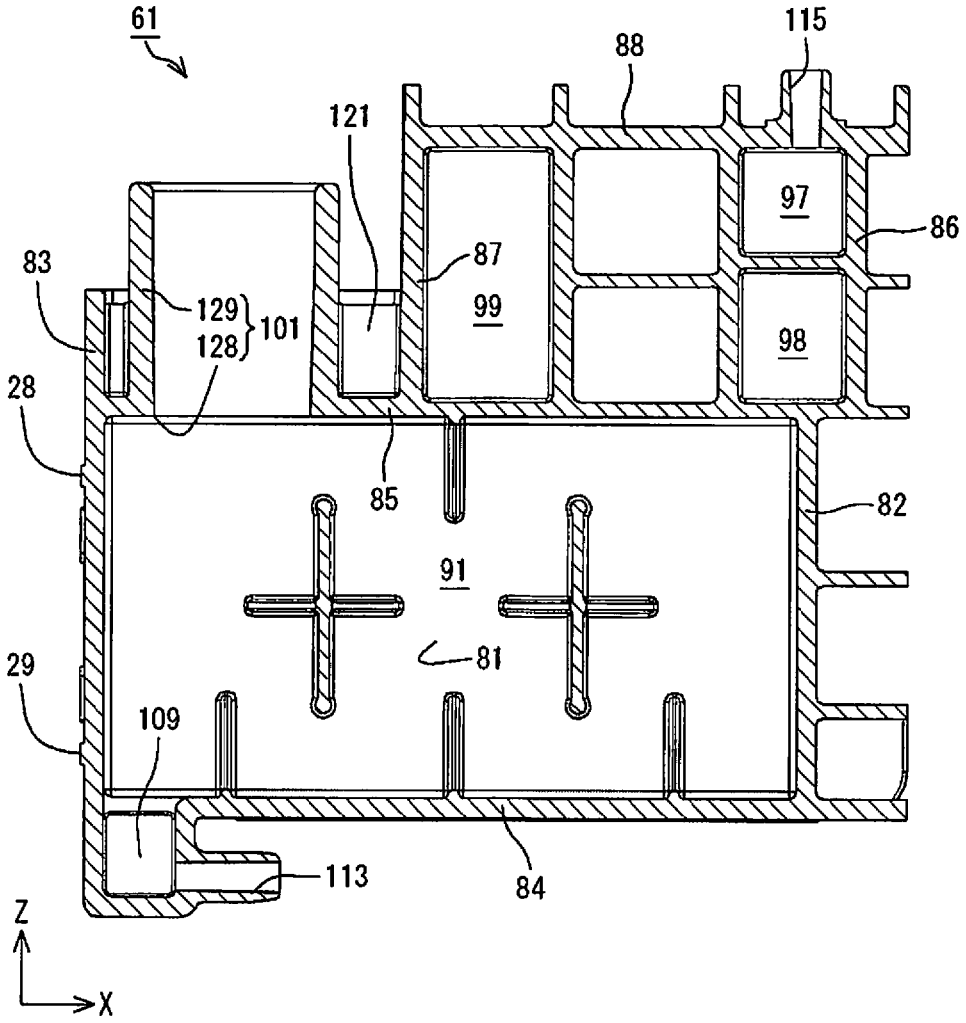
FIG. 7 is a cross-sectional view of when an ink injection section, a supply port, and an air communication port in the present embodiments are cut in the XZ plane.

The ink injection section 101 has an opening 128 and a side wall 129, as illustrated in FIG. 7, which is a cross-sectional view of when the ink injection section 101, the supply port 113, and the air communication port 115 are cut along the XZ plane. The opening 128 is a through hole that is provided to the fifth wall 85. The opening 128 is also an intersection at which the ink injection section 101 and the storage section 65 intersect together. A configuration with which the side wall 129 projects out to the inside of the storage section 65 could also be employed as the configuration of the ink injection section 101. In a configuration with which the side wall 129 projects out to the inside of the storage section 65, as well, the intersection at which the ink injection section 101 and the storage section 65 intersect together would be defined as being the opening 128. The recess 91 is communicated to the outside of the recess 91 via the opening 128, which is a through hole. The side wall 129 is provided to the side of the fifth wall 85 opposite to the fourth wall 84 side and surrounds the periphery of the opening 128, thus forming an ink injection path. The side wall 129 projects out from the fifth wall 85 toward the side opposite to the fourth wall 84 side. In the present embodiment, the side wall 129 projects out to the side opposite to the fourth wall 84 side more than each of the first wall 81 and the third wall 83. The side wall 129 makes it possible to prevent ink that has collected in the recess 121 from flowing into the opening 128. The first buffer chamber 74 (FIG. 5), is located above the opening 128 in the Z-axis direction.

Figure 8:
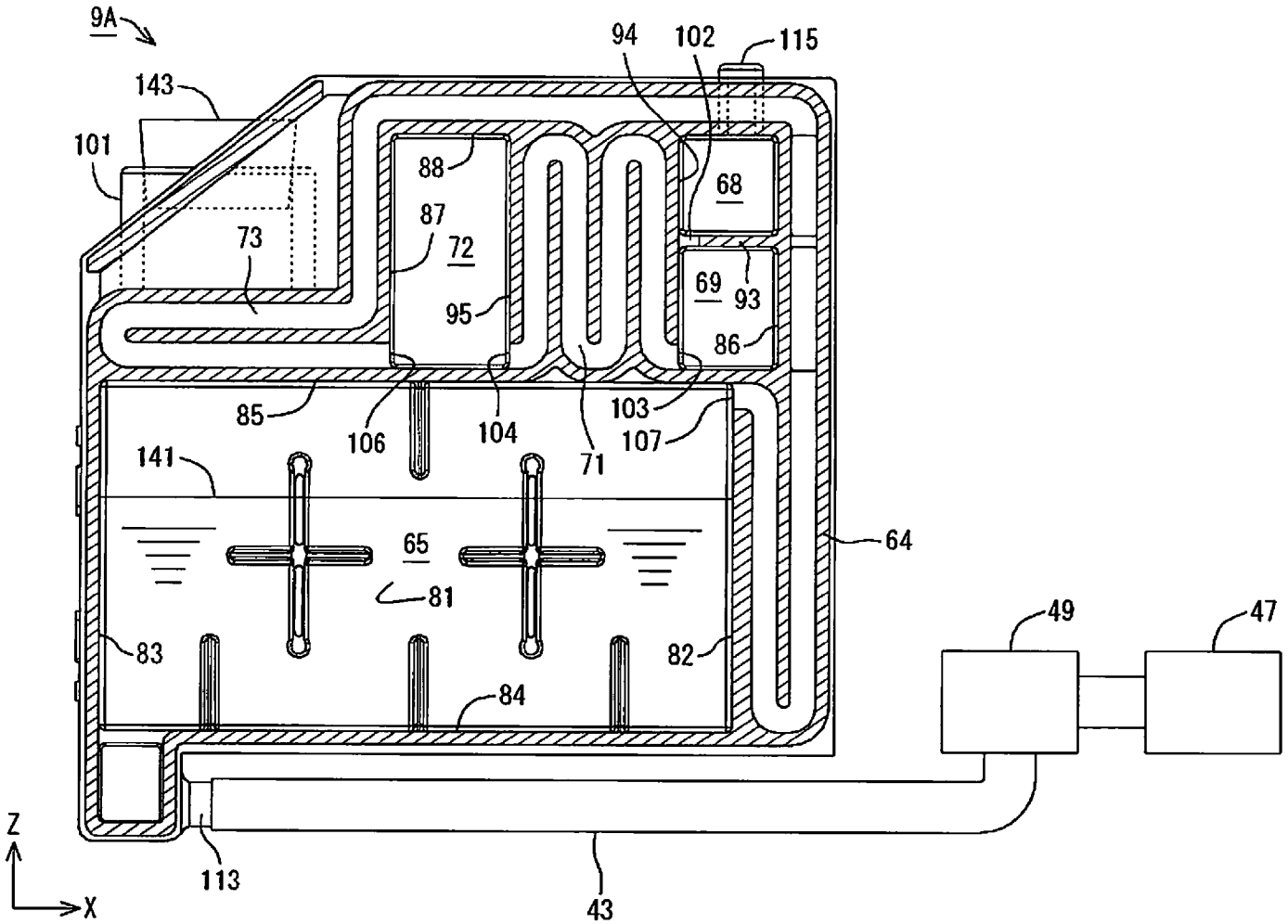
FIG. 8 is a side view of when a tank in the first embodiment is viewed from a sheet member side.

In the tank 9A, an ink 141 is stored in the interior of the storage section 65, as illustrated in FIG. 8, which is a side view of when the tank 9A is viewed from the sheet member 63 side. FIG. 8 omits any depiction of the sheet member 63 and depicts the bonding sections 64 with hatching in order to better illustrate the configuration. The ink 141 inside the storage section 65 is supplied to the print head 47 from the supply port 113. In the present embodiment, in a state where the printer 1 is used for printing, then the supply tube 43 is connected to the supply port and a cap 143 is attached to the ink injection section 101. Suction through the inside the supply tube 43 via the relay unit 49 causes the ink 141 inside the recess 91 to arrive at the print head 47 from the supply port 113.

In association with the printing by the print head 47, the ink 141 inside the storage section 65 is sent to the print head 47 side. For this reason, the pressure inside the storage section 65 becomes lower than the atmospheric pressure in association with the printing by the print head 47. When the pressure inside the storage section 65 becomes lower than the atmospheric pressure, then the air inside the third air chamber 72 passes through the second communicating passage 73 and is sent to inside the storage section 65. This makes it easier for the pressure inside the storage section 65 to be kept at atmospheric pressure. The air flows into the third air chamber 72 from the air communication port 115 after passing by way of the first air chamber 68, the second air chamber 69, and the first communicating passage 71, in the stated order. By the above, the ink 141 inside the tank 9A is supplied to the print head 47. When the ink 141 inside the storage section 65 in the tank 9A is consumed and little of the ink 141 remains, then the worker can refill the inside of the storage section 65 with new ink from the ink injection section 101.

Figure 9:
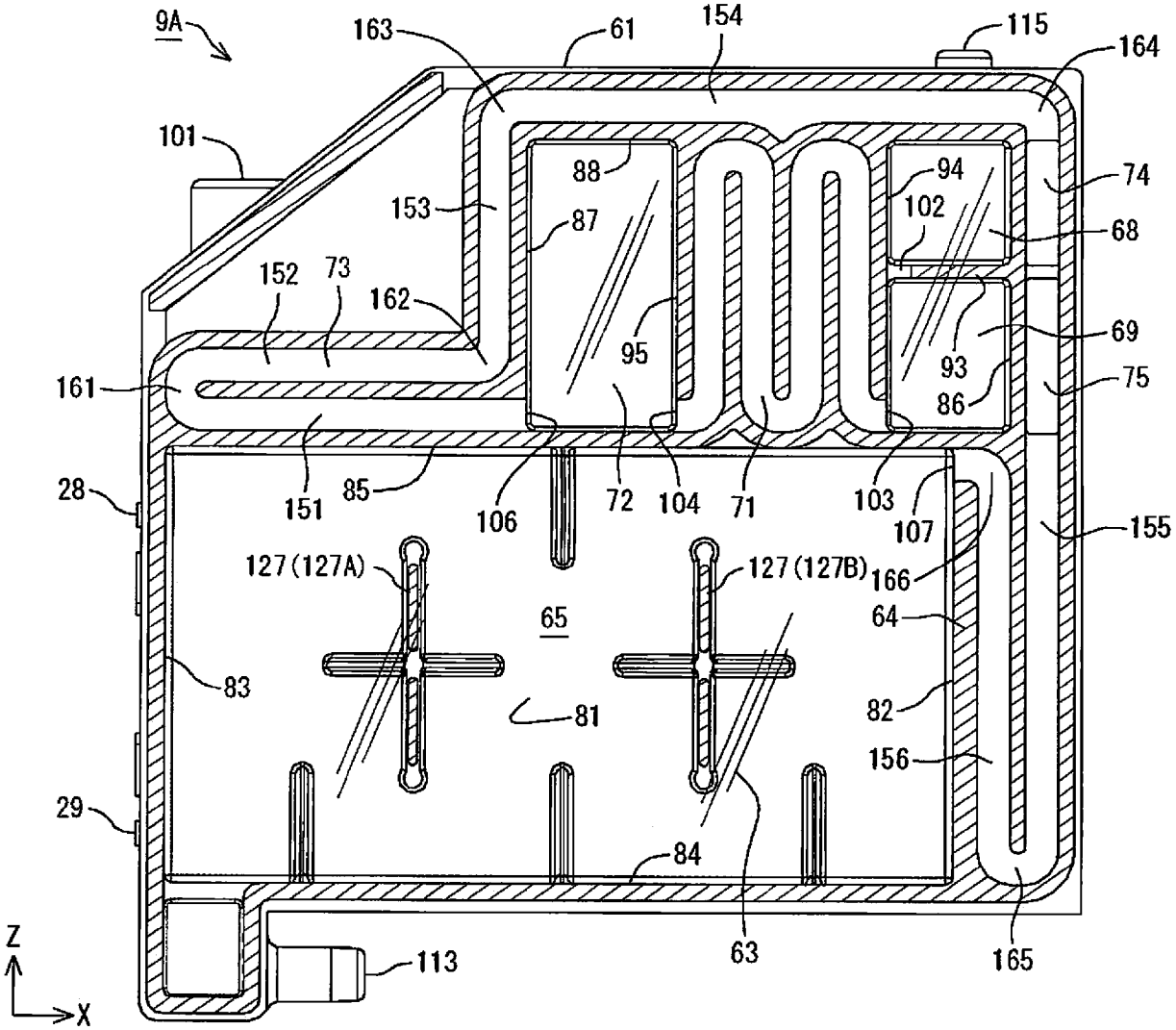
FIG. 9 is a side view of when a tank in the first embodiment is viewed from a sheet member side.

The second communicating passage 73, as illustrated in FIG. 9, can be sectioned into a first passage 151, a second passage 152, a third passage 153, a fourth passage 154, a fifth passage 155, and a sixth passage 156. The first passage 151 originates at the communication port 106 and goes toward the third wall 83 along the fifth wall 85, i.e., along the X-axis direction. The first passage 151 leads from the communication port 106 to a reversal section 161. The reversal section 161 is a site where the orientation of the flow path in the second communicating passage 73 is reversed. At the reversal section 161, the orientation of the flow path is reversed from the −X-axis direction to the +X-axis direction. In the route taken by the air from the air communication port 115 leading to the storage section 65, the air communication port 115 side is the upstream side and the communication port 107 side is the downstream side.

The second passage 152 goes from the reversal section 161 toward the seventh wall 87 along the direction of extension of the first passage 151, i.e., along the X-axis direction. The second passage 152 leads from the reversal section 161 to a bend section 162. The bend section 162 is a site where the orientation of the flow path in the second communicating passage 73 is bent. At the bend section 162, the orientation of the flow path is bent from the +X-axis direction to the +Z-axis direction. The third passage 153 goes from the bend section 162 toward the eighth wall 88 along the seventh wall 87, i.e., along the Z-axis direction. The third passage 153 leads from the bend section 162 to a bend section 163. The bend section 163 is a site where the orientation of the flow path in the second communicating passage 73 is bent. At the bend section 163, the orientation of the flow path is bent from the +Z-axis direction to the +X-axis direction.

The fourth passage 154 goes from the bend section 163 toward the sixth wall 86 along the eighth wall 88, i.e., along the X-axis direction. In the Z-axis direction, the fourth passage 154 is located above the third air chamber 72. The fourth passage 154 leads from the bend section 163 to a bend section 164. The bend section 164 is a site where the orientation of the flow path in the second communicating passage 73 is bent. At the bend section 164, the orientation of the flow path is bent from the +X-axis direction to the −Z-axis direction. The fifth passage 155 leads from the bend section 164 toward the fourth wall 84 along the sixth wall 86, i.e., along the Z-axis direction. The fifth passage 155 leads from the bend section 164 toward a reversal section 165.

As stated above, in the Z-axis direction, the fourth passage 154 is located above the third air chamber 72. In other words, a part of the second communicating passage 73 is located above the third air chamber 72. According to this configuration, the ink that has flowed into the second communicating passage 73 from the storage section 65 will less readily rise above the third air chamber 72, due to the action of gravity. For this reason, ink that has flowed into the second communicating passage 73 from the storage section 65 will less readily arrive at the third air chamber 72. As a result, it is easier to prevent ink that has flowed from the storage section 65 into the second communicating passage 73 from leaking out from the tank 9A.

Also, in the tank 9A, the third passage 153 and the fifth passage 155 are located at mutually opposite sides across the third air chamber 72 in the X-axis direction. According to this configuration, the route of the second communicating passage 73 can be lengthened by putting the space surrounding the third air chamber 72 to use and forming the second communicating passage 73 so as to run around the third air chamber 72. Lengthening the route of the second communicating passage 73 is preferable from the viewpoint of making it less likely that the liquid component of the ink inside the storage section 65 will evaporate and from the viewpoint of making it less likely that the ink that has flowed from the storage section 65 into the second communicating passage 73 will arrive at the third air chamber 72.

The reversal section 165 is a site where the orientation of the flow path in the second communicating passage 73 is reversed. At the reversal section 165, the orientation of the flow path is reversed from the −Z-axis direction to the +Z-axis direction. The sixth passage 156 goes from the reversal section 165 toward the fifth wall 85 along the second wall 82, i.e., along the Z-axis direction. The sixth passage 156 leads from the reversal section 165 to the communication port 107 by way of a bend section 166. The bend section 166 is a site where the orientation of the flow path in the second communicating passage 73 is bent. The second communicating passage 73 is communicated to inside the storage section 65 via the communication port 107 after the orientation of the flow path is bent in the bend section 166 from the +Z-axis direction to the −X-axis direction.

The first buffer chamber 74 and the second buffer chamber 75 are each provided to the fifth passage 155 in the second communicating passage 73. The first buffer chamber 74 is arranged between ninth wall 93 and the eighth wall 88 in the Z-axis direction. The second buffer chamber 75 is arranged between the fifth wall 85 and the ninth wall 93 in the Z-axis direction. For this reason, in the vertical direction, the first buffer chamber 74 is located above the second buffer chamber 75.

The places of arrangement of the first buffer chamber 74 and the second buffer chamber 75 are not limited to the fifth passage 155. Any of the sites of the first passage 151 through sixth passage 156 could also be employed as the places of arrangement of the first buffer chamber 74 and the second buffer chamber 75. Also, any of the sites of the reversal section 161, the reversal section 165, the bend section 162, the bend section 163, the bend section 164, and the bend section 166 could also be employed as the places of arrangement of the first buffer chamber 74 and the second buffer chamber 75.

The communication port 106 is located at the intersection at which the seventh wall 87 and the fifth wall 85 intersect together. In another viewpoint, the communication port 106 is located at the lower end of the third air chamber 72 in the vertical direction. The communication port 107 is located at the intersection at which the second wall 82 and the fifth wall 85 intersect together. In another viewpoint, the communication port 107 is located at the upper end of the storage section 65 in the vertical direction. In the present embodiment, the communication port 107 is located below the second buffer chamber 75 in the vertical direction. The communication port 103 is located at the intersection at which the fifth wall 85 and the tenth wall 94 intersect together. In another viewpoint, the communication port 103 is located at a lower end of the second air chamber 69 in the vertical direction. The communication port 104 is located at the intersection at which the fifth wall 85 and the eleventh wall 95 intersect together. In another viewpoint, the communication port 104 is located at the lower end of the third air chamber 72 in the vertical direction.

Herein, the communication port 107 is located above the upper limit mark 28 in the vertical direction, as illustrated in FIG. 7. The upper limit mark 28 is located below the fifth wall 85 in the vertical direction. For this reason, the upper limit mark 28 is located below the opening 128 of the ink injection section 101 in the vertical direction. This makes it easier to avoid an event where ink would surpass the upper limit mark 28 and arrive at the opening 128 when the worker is injecting the ink into the tank 9A from the ink injection section 101. For this reason, it is easier to avoid an event where the ink overflows from the ink injection section 101 when the worker is injecting the ink into the tank 9A from the ink injection section 101.

In the first embodiment, the Z-axis direction corresponds to a direction intersecting with the horizontal direction, the storage section 65 corresponds to a liquid storage section, the ink injection section 101 corresponds to a liquid injection section, the opening 128 corresponds to a liquid injection port, and the third air chamber 72 corresponds to an air chamber. The air communication port 115, the first air chamber 68, the communication port 102, the second air chamber 69, and the first communicating passage 71 correspond to an air introduction section. The second communicating passage 73 corresponds to a communicating passage, each of the first buffer chamber 74 and the second buffer chamber 75 corresponds to a collection section, and the case 61 corresponds to a case member. The support sections 127 correspond to ribs. The second wall 82 and the third wall 83 correspond to two inner walls that face one another across ribs. One among either the third passage 153 or the fifth passage 155 corresponds to a first portion and the other among the third passage 153 and the fifth passage 155 corresponds to a second portion.

In the first embodiment, the first buffer chamber 74 and the second buffer chamber 75 are provided to the second communicating passage 73. For this reason, even though, for example, the ink inside the storage section 65 might flow back toward the third air chamber 72 side through the second communicating passage 73, the ink can be captured at the first buffer chamber 74 and the second buffer chamber 75, and therefore the ink inside the storage section 65 can be more easily prevented from arriving at the third air chamber 72. This makes it easier to avoid an event where the ink inside the storage section 65 leaks out from the air communication port 115 to the outside of the tank 9A. The number of the buffer chambers, however, is not limited to being two, namely, the first buffer chamber 74 and the second buffer chamber 75. One or a number three or higher could also be employed as the number of buffer chambers.

Figure 10A:
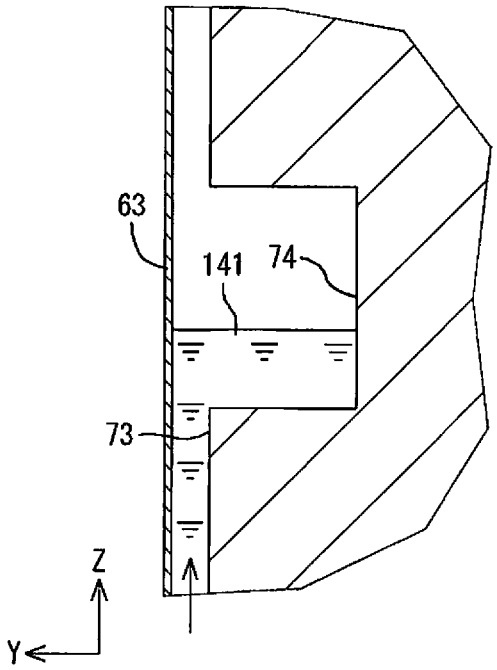
FIGS. 10A and 10B are cross-sectional views of when a first buffer chamber in the first embodiment is cut in the YZ plane.

In the first embodiment, the first buffer chamber 74 and the second buffer chamber 75 are provided to the fifth passage 155 (FIG. 9) of the second communicating passage 73. In a case where the ink inside the storage section 65 flows back toward the third air chamber 72 side through the second communicating passage 73, then the ink that has flowed back will at the fifth passage 155 be flowing from the bottom to the top in the Z-axis direction. The orientation of this flow is opposite to the orientation of when the air is flowing from the third air chamber 72 side toward the storage section 65 side. The ink 141 that flows from the bottom to the top through the fifth passage 155 will collect going from the bottom toward the top of the first buffer chamber 74, as illustrated in FIG. 10A, which is a cross-sectional view of when the first buffer chamber 74 is cut in the YZ plane. For this reason, the liquid level of the ink 141 that has arrived at the first buffer chamber 74 rises from the bottom toward the top of the first buffer chamber 74.

Figure 10B:
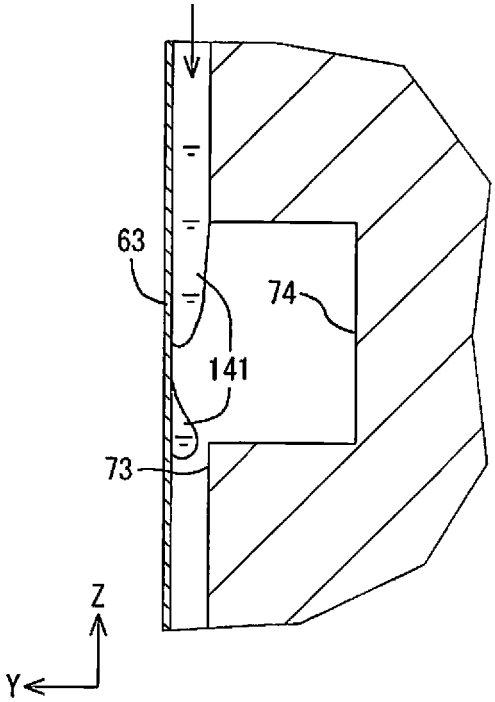

Here, in a case where, for example, the ink 141 flowing back from the storage section 65 side toward the third air chamber 72 side flows from the top toward the bottom in the fifth passage 155, then the ink 141 flowing back flows toward the first buffer chamber 74 from above the first buffer chamber 74. At this time, as illustrated in FIG. 10B, conceivably either the ink 141 could fail to arrive at the interior of the first buffer chamber 74 and would instead end up passing through the first buffer chamber 74, or the ink 141 that has arrived at inside the first buffer chamber 74 could end up flowing out from the first buffer chamber 74 by the action of gravity. In such an event, it is not possible to fully exploit the capacity of the first buffer chamber 74.

By contrast to such an event, in the present embodiment, the ink 141 that has arrived at the first buffer chamber 74 will collect going from the bottom toward the top of the first buffer chamber 74, and therefore it is possible to efficiently exploit the capacity of the first buffer chamber 74.

Also, according to the present embodiment, the first buffer chamber 74 has a smaller cross-sectional area than the cross-sectional area of the third air chamber 72, and therefore the distance in the horizontal direction from the inner wall of the first buffer chamber 74 to the second communicating passage 73 is shorter than the distance in the horizontal direction from the inner wall of the third air chamber 72 to the second communicating passage 73. For this reason, the ink inside the first buffer chamber 74 more easily arrives at the second communicating passage 73 as compared to the ink that has flowed into the third air chamber 72. In other words, the ink inside the first buffer chamber 74 more easily returns to the second communicating passage 73 as compared to the ink that has flowed into the third air chamber 72. This makes it possible to reduce the amount of ink that remains inside the first buffer chamber 74 beyond the amount of ink that remains inside the third air chamber 72. As a result, in a case where ink in an amount that can be captured with the first buffer chamber 74 flows out to the third air chamber 72 side from the storage section 65, then the amount of ink that remains in the first buffer chamber 74 can be reduced and therefore waste of the ink can be mitigated.

In the first embodiment, the first buffer chamber 74 is provided to the upstream side of the second buffer chamber 75, and therefore ink that has overflowed from the second buffer chamber 75 can be captured with the first buffer chamber 74. This makes it easy to even further prevent the ink inside the storage section 65 from arriving at the third air chamber 72, and therefore makes it easy to even further avoid an event where the ink inside the storage section 65 leaks out from the air communication port 115 to the outside of the tank 9A.

In the first embodiment, as stated above, the first buffer chamber 74 is located above the opening 128 in the Z-axis direction. According to this configuration, even though, for example, the ink might be injected to capacity up until the opening 128, the ink is less likely to advance to a position higher than the opening 128, and therefore it is easier to avoid an event where the first buffer chamber 74 ends up being filled with the ink. To easily avoid the event where the first buffer chamber 74 ends up being filled with the ink, it suffices for at least a part of the first buffer chamber 74 to be located above the opening 128 in the Z-axis direction. In this configuration, it is still possible to make it easier to avoid the event where the first buffer chamber 74 ends up being filled with the ink.

In the first embodiment, the communication port 107 is located above the upper limit mark 28 in the vertical direction. For this reason, it is easier to avoid an event where the ink inside the storage section 65 arrives at the communication port 107. As a result, it is easier to prevent the ink inside the storage section 65 from flowing from the communication port 107 to inside the second communicating passage 73, and therefore it is easier to avoid an event where the ink inside the storage section 65 leaks out from the air communication port 115 to the outside of the tank 9A.

In the first embodiment, the communication port 107 is located at the upper end of the storage section 65 in the vertical direction. For this reason, in the state where the printer 1 is used, it is easier to prevent the ink inside the storage section 65 from flowing from the communication port 107 to inside the second communicating passage 73. As a result, it is easier to avoid an event where the ink inside the storage section 65 leaks out from the air communication port 115 to the outside of the tank 9A.

In the first embodiment, the reversal section 165 is provided to the second communicating passage 73. The second communicating passage 73 reverses at the reversal section 165 from an orientation going vertically downward from vertically above to an orientation going vertically upward from vertically below. For this reason, when the posture of the tank 9A is not turned in the state where the ink has entered into the second communicating passage 73 from the communication port 107, then the ink that has entered into the second communicating passage 73 does not readily surpass the reversal section 165 and flow back to the upstream side of the fifth passage 155. For this reason, it is easy to even further prevent the ink inside the storage section 65 from arriving at the third air chamber 72.

In the first embodiment, the support sections 127 that project out toward the sheet member 63 side from the first wall 81 of the case 61 are provided. For this reason, the sheet member 63 can be supported with the support sections 127 when, for example, the sheet member 63 is pressed toward the first wall 81 of the case 61, i.e., toward the inside of the storage section 65. This makes it easier to regulate flexure of the sheet member 63. As a result, it is possible to mitigate any contraction of the capacity inside the storage section 65 when, for example, the sheet member 63 is pressed toward the inside of the storage section 65. For this reason, it is easier to avoid an event where the ink inside the storage section 65 would flow from the communication port 107 into the second communicating passage 73 when, for example, the sheet member 63 is pressed toward the inside of the storage section 65.

In the first embodiment, there are the plurality of support sections 127 provided to inside the storage section 65, and therefore it is possible to further mitigate any contraction of the capacity inside the storage section 65 when the sheet member 63 is pressed toward the inside of the storage section 65. For this reason, it is easy to even further avoid an event where the ink inside the storage section 65 would flow from the communication port 107 into the second communicating passage 73 when, for example, the sheet member 63 is pressed toward the inside of the sheet member 63.

In the first embodiment, the sheet member 63 is bonded to the bonding sections 64 provided to the support sections 127. For this reason, positional displacement of the sheet member 63 is easily prevented. Also, any increase in the capacity inside the storage section 65 can be mitigated at times such as when, for example, the pressure inside the storage section 65 becomes higher than the atmospheric pressure.

The above embodiment illustrates an example where the tank 9A is constituted of the case 61 and the sheet member 63, but the configuration of the tank 9A is not limited thereto. An example where, for example, the case 61 is constituted of a plurality members could also be employed as the configuration of the tank 9A. Examples where the case 61 is constituted of a plurality of members include an example where the first wall 81 of the case 61 is constituted of another member. Further, examples where the first wall 81 of the case 61 is constituted of another member include an example where the first wall 81 is constituted of a sheet member different from the sheet member 63. This example would be a configuration where the case 61 is sandwiched between the sheet member 63 and the other sheet member. The tank 9A can be configured by this configuration, as well.

Figure 11A:
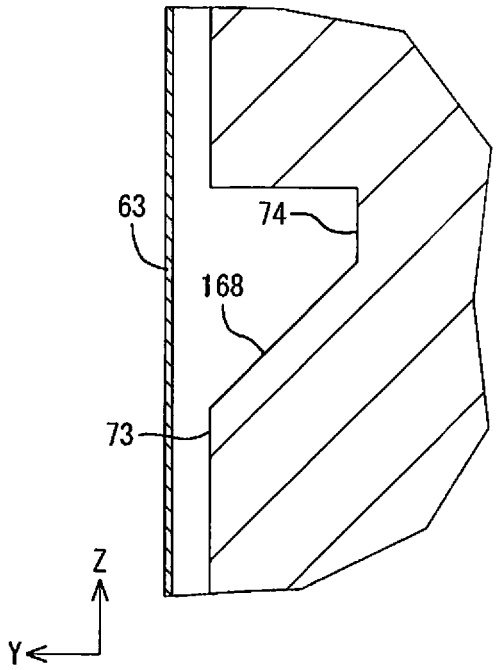
FIGS. 11A and 11B are cross-sectional views illustrating another example of a first buffer chamber in the first embodiment.

In the above first embodiment, it would also be possible to employ a configuration where the depth of the first buffer chamber 74 is less on the lower side than the upper side of the first buffer chamber 74 in the Z-axis direction, as illustrated in FIG. 11A. In the example illustrated in FIG. 11A, a slope 168 is provided to inside the first buffer chamber 74. The slope 168 is sloped at an orientation which increasingly approaches the sheet member 63 side going from the upper side toward the lower side of the first buffer chamber 74, i.e., with which the first buffer chamber 74 becomes increasingly shallow going from the upper side toward the lower side of the first buffer chamber 74.

According to this configuration, ink that has collected in the first buffer chamber 74 more readily returns from the lower side of the first buffer chamber 74 to the second communicating passage 73, due to the action of gravity toward the lower side of the first buffer chamber 74. At this time, when the configuration is one where the first buffer chamber 74 is shallower at the lower side than the upper side, the ink inside the first buffer chamber 74 more readily approaches the second communicating passage 73 at the lower side more than the upper side of the first buffer chamber 74. For this reason, going from the upper side toward the lower side of the first buffer chamber 74, the ink inside the first buffer chamber 74 becomes increasingly easier to guide to the second communicating passage 73. As a result, ink that has collected in the first buffer chamber 74 is more readily returned to the second communicating passage 73. This makes it possible to even further reduce the amount of ink that remains in the first buffer chamber 74, and therefore makes it possible to even further mitigate waste of the ink.

Figure 11B:
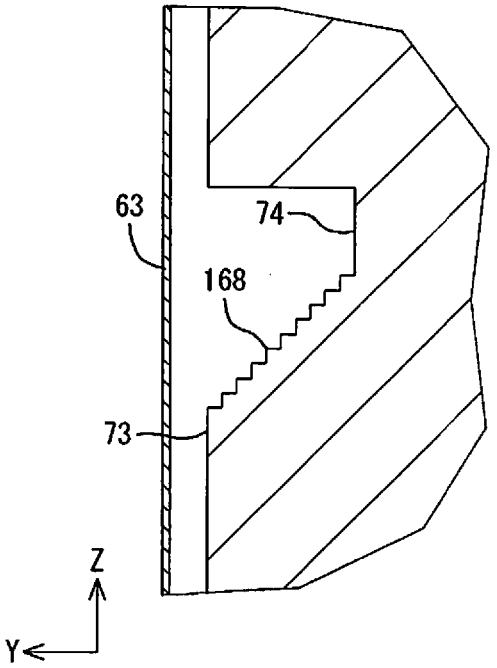

As a method for causing the first buffer chamber 74 to become shallower at the lower side than the upper side, it would also be possible to employ, for example, a method where the slope 168 is configured so as to be stepwise, as illustrated in FIG. 11B. A similar effect is still obtained with this configuration, too. A configuration where the slope 168 is also provided in the second buffer chamber 75 could also be employed. When the slope 168 is provided to the second buffer chamber 75 as well, the amount of ink that remains in the second buffer chamber 75 can also be further reduced, and therefore waste of the ink can be even further mitigated. FIGS. 11A and 11B, it should be noted, each illustrate cross-sectional views of when the first buffer chamber 74 is cut in the YZ plane.

(Second Embodiment)

Figure 12:
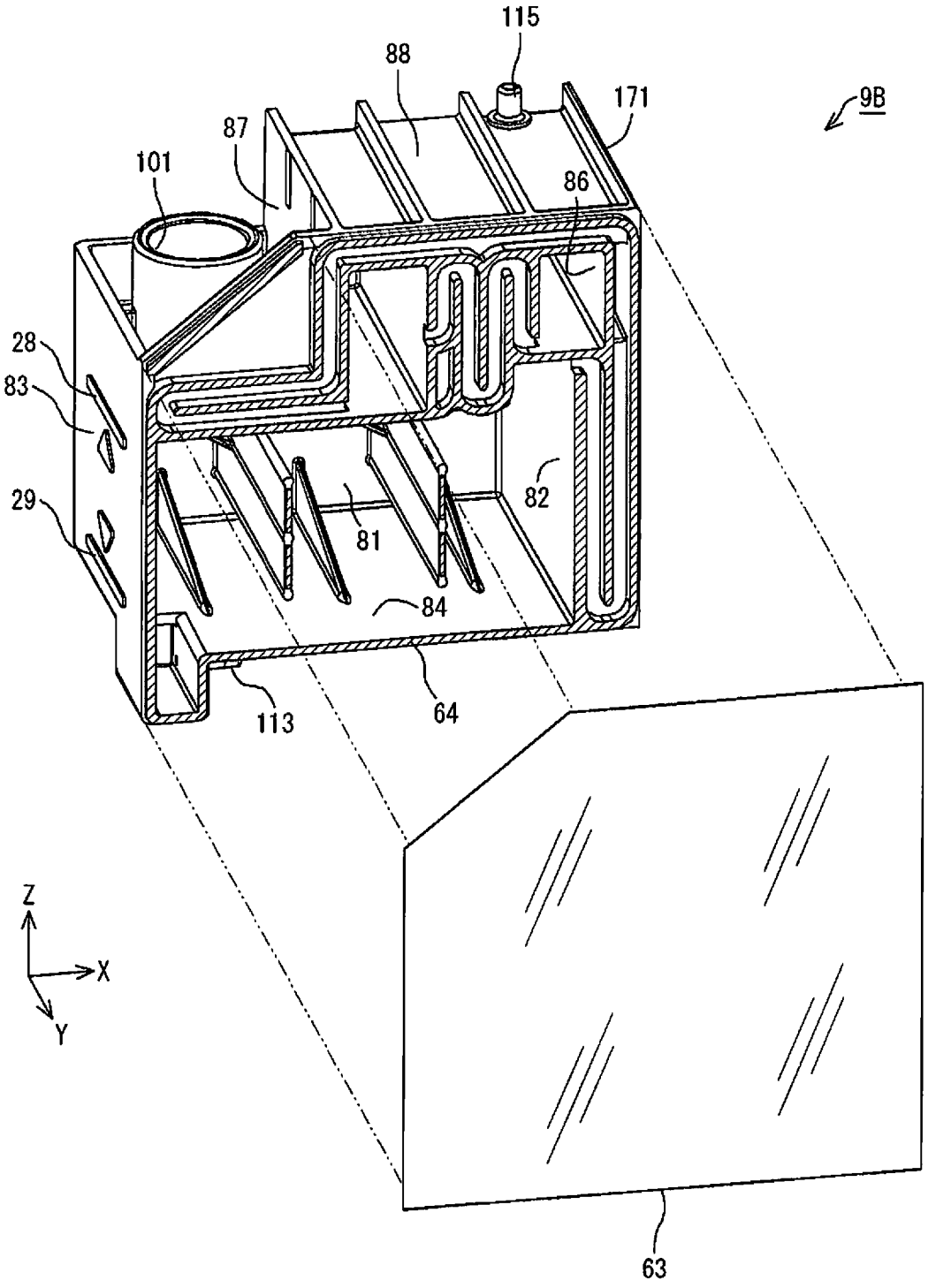
FIG. 12 is an exploded perspective view illustrating a tank in a second embodiment.

A tank 9B in the second embodiment shall now be described. In the second embodiment, configurations that are the same as in the first embodiment are assigned the same reference numerals as in the first embodiment and a detailed description thereof is omitted. The tank 9B, as illustrated in FIG. 12, has a case 171 and the sheet member 63. The case 171 is constituted of, for example, a synthetic resin such as nylon or polypropylene. The tank 9B has a configuration where the case 171 and the sheet member 63 are bonded together. The bonding sections 64 are provided to the case 171. FIG. 12 depicts the bonding sections 64 with hatching in order to better illustrate the configuration. The sheet member 63 is bonded to the bonding sections 64 of the case 171. In the present embodiment, the case 171 and the sheet member 63 are bonded together by welding.

Figure 13:
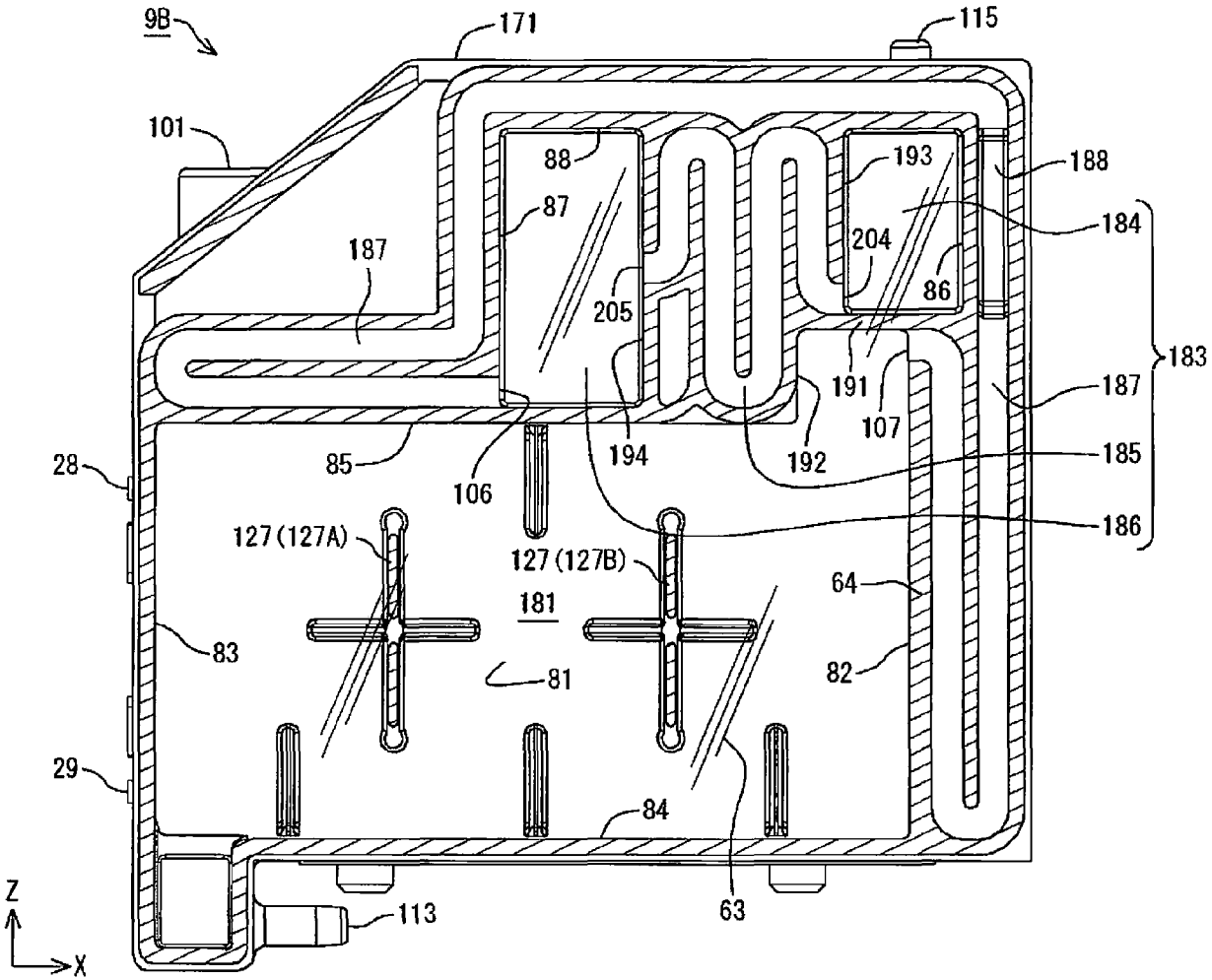
FIG. 13 is a side view of when a tank in the second embodiment is viewed from a sheet member side.

The tank 9B, as illustrated in FIG. 13, has a storage section 181 and a communicating section 183. The communicating section 183 has a first air chamber 184, a first communicating passage 185, a first air chamber 186, a second communicating passage 187, and a buffer chamber 188. The ink in stored inside the storage section 181. FIG. 13 illustrates a state where the tank 9B is viewed from the sheet member 63 side, and depicts the case 171 with the sheet member 63 in between. The storage section 181, the first air chamber 184, the first communicating passage 185, the second air chamber 186, and the second communicating passage 187 are partitioned from one another by the bonding sections 64. The buffer chamber 188 is provided to inside the second communicating passage 187.

The case 171 has the first wall 81 through eighth wall 88, similarly with respect to the case 61. The case 171 also has a ninth wall 191, a tenth wall 192, an eleventh wall 193, and a twelfth wall 194. The first air chamber 184, the first communicating passage 185, and the second air chamber 186 are arranged on the side opposite to the storage section 181 side from the fifth wall 85. When the first wall 81 is seen in plan view from the sheet member 63 side, the storage section 181 is surrounded by the second wall 82, the third wall 83, the fourth wall 84, the fifth wall 85, the ninth wall 191, and the tenth wall 192.

When the first wall 81 is seen in plan view from the sheet member 63 side, then the first air chamber 184, the first communicating passage 185, and the second air chamber 186 are surrounded by the fifth wall 85, the sixth wall 86, the seventh wall 87, the eighth wall 88, the ninth wall 191, and the tenth wall 192. The first wall 81 of the storage section 181 and the first wall 81 of the first air chamber 184 and second air chamber 186 are the same wall as one another. In other words, in the present embodiment, the first wall 81 is shared among the storage section 181, the first air chamber 184, and the second air chamber 186. The ink injection section 101, the supply port 113, and the air communication port 115 are also provided to the case 171. The places of arrangement of the ink injection section 101, the supply port 113, and the air communication port 115 are each similar to as in the first embodiment.

Figure 14:
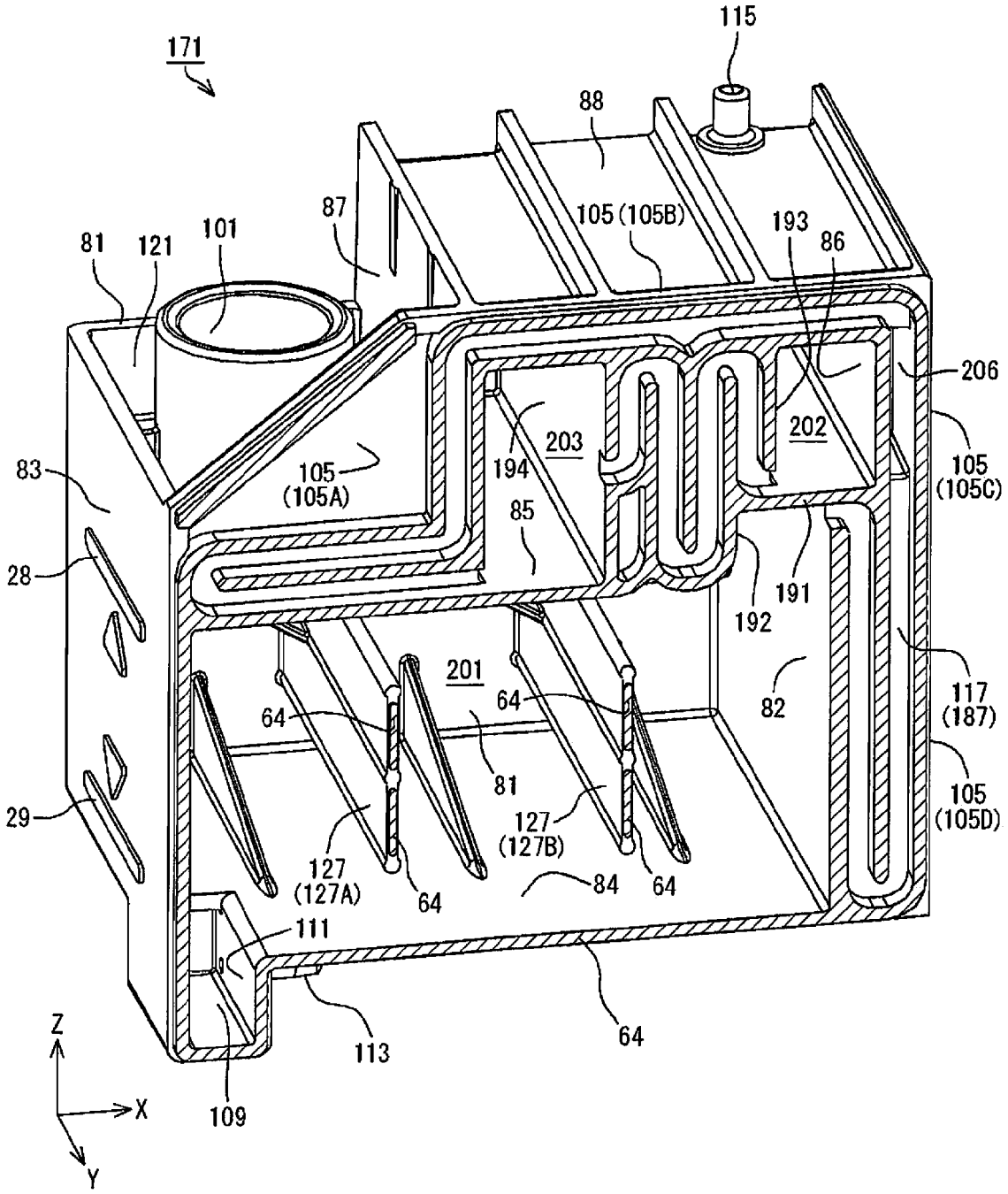
FIG. 14 is a perspective view illustrating a case in the second embodiment.

The second wall 82, the third wall 83, the fourth wall 84, the fifth wall 85, the ninth wall 191, and the tenth wall 192 each intersect with the first wall 81, as illustrated in FIG. 14. The second wall 82 and the third wall 83 are provided to positions that face each other across the first wall 81 in the X-axis direction. The fourth wall 84 and the fifth wall 85 are provided to positions that face each other across the first wall 81 in the Z-axis direction. The third wall 83 intersects with each of the fourth wall 84 and the fifth wall 85. The ninth wall 191 is located to the side opposite to the storage section 181 side from the fifth wall 85. In other words, the ninth wall 191 is located above the fifth wall 85 in the vertical direction. The ninth wall 191 faces the fourth wall 84. The second wall 82 intersects with each of the fourth wall 84 and the ninth wall 191. The tenth wall 192 is located between the second wall 82 and the third wall 83. The tenth wall 192 faces the second wall 82. The tenth wall 192 intersects with each of the fifth wall 85 and the ninth wall 191.

The second wall 82, the third wall 83, the fourth wall 84, the fifth wall 85, the ninth wall 191, and the tenth wall 192 project out to the +Y-axis direction form the first wall 81. Due to this, where the first wall 81 is a main wall, a recess 201 is configured by the second wall 82, the third wall 83, the fourth wall 84, the fifth wall 85, the ninth wall 191, and the tenth wall 192 which extend in the +Y-axis direction from the main wall. The recess 201 is configured with an orientation so as to be concave going towards the −Y-axis direction. The recess 201 forms an opening going toward the +Y-axis direction, i.e., toward the sheet member 63 (FIG. 12) side. In other words, the recess 201 is provided at an orientation so as to be concave going toward the −Y-axis direction, i.e., toward the side opposite to the sheet member 63 (FIG. 12) side. When the sheet member 63 is bonded to the case 171, the recess 201 is closed off by the sheet member 63, thus constituting the storage section 181. The first wall 81 through eighth wall 88, the ninth wall 191, and the tenth wall 192 each are not limited to being flat walls, and may also be ones that comprise irregularities.

The sixth wall 86 projects out from the ninth wall 191 toward the side of the ninth wall 191 opposite to the fourth wall 84 side, i.e., toward the +Z-axis direction side of the ninth wall 191, as illustrated in FIG. 13. The seventh wall 87 projects out from the fifth wall 85 toward the side of the fifth wall 85 opposite to the fourth wall 84 side, i.e., toward the +Z-axis direction side of the fifth wall 85. The sixth wall 86 and the seventh wall 87 are provided to positions facing one another across the first air chamber 184, the first communicating passage 185, and the second air chamber 186 in the X-axis direction. The eighth wall 88 is provided to a position facing the fifth wall 85 and the ninth wall 191 across the first air chamber 184, the first communicating passage 185, and the second air chamber 186 in the Z-axis direction. The sixth wall 86 intersects with each of the ninth wall 191 and the eighth wall 88. The seventh wall 87 intersects with each of the fifth wall 85 and the eighth wall 88.

The eleventh wall 193 and the twelfth wall 194 are provided between the sixth wall 86 and the seventh wall 87. Between the first air chamber 184 and the second air chamber 186, a separation is formed in the X-axis direction by the eleventh wall 193 and the twelfth wall 194. The eleventh wall 193 is provided to the seventh wall 87 side more than the sixth wall 86, and faces the sixth wall 86. The twelfth wall 194 is provided to the sixth wall 86 side more than the seventh wall 87, and faces the seventh wall 87. The twelfth wall 194 is provided to the seventh wall 87 side more than the eleventh wall 193.

The sixth wall 86, the seventh wall 87, the eighth wall 88, the eleventh wall 193, and the twelfth wall 194 each project out in the +Y-axis direction from the first wall 81, as illustrated in FIG. 14. The sixth wall 86, the ninth wall 191, the eleventh wall 193, and the eighth wall 88, which extend in the +Y-axis direction from the first wall 81, together constitute a recess 202. The fifth wall 85, the seventh wall 87, the eighth wall 88, and the twelfth wall 194, which extend in the +Y-axis direction from the first wall 81, together constitute a recess 203.

The recess 202 and the recess 203 each form an opening going toward the +Y-axis direction, i.e., toward the sheet member 63 (FIG. 12) side. In other words, the recess 202 and the recess 203 are each provided at an orientation so as to be concave going toward the −Y-axis direction, i.e., toward the side opposite to the sheet member 63 (FIG. 12) side. Then, when the sheet member 63 is bonded to the case 171, the recess 202 is closed off by the sheet member 63, thus constituting the first air chamber 184. Likewise, when the sheet member 63 is bonded to the case 171, the recess 203 is closed off by the sheet member 63, thus constituting the second air chamber 186. The amounts by which the second wall 82 through eighth wall 88 and the ninth wall 191 through twelfth wall 194 project out from the first wall 81 are set so as to be the same amount of projection to one another.

The first communicating passage 185 is provided between the eleventh wall 193 and the twelfth wall 194, as illustrated in FIG. 13, and forms communication between the first air chamber 184 and the second air chamber 186. The second communicating passage 187 is provided to the outside of the storage section 181, the first air chamber 184, the first communicating passage 185, and the second air chamber 186. The second communicating passage 187 forms communication between the second air chamber 186 and the storage section 181. A communication port 204 is provided to the eleventh wall 193. The first air chamber 184 is communicated to the first communicating passage 185 via the communication port 204. A communication port 205 is also provided to the twelfth wall 194. The second air chamber 186 is communicated to the first communicating passage 185 via the communication port 205. The first communicating passage 185 is meandering. The first air chamber 184 is communicated to the second air chamber 186 after meandering through the first communicating passage 185.

The extended section 105, as in the first embodiment, is also provided to the case 171, as illustrated in FIG. 14. In the case 171, as well, the second communicating passage 187 is provided to the extended section 105. In the case 171, as well, the extended section 105 has the site 105A, the site 105B, the site 105C, and the site 105D. Similarly to the first embodiment, the second communicating passage 187 is configured as the groove 117 that is provided to the extended section 105 at an orientation so as to be concave going toward the side opposite to the sheet member 63 side.

The second communicating passage 187 has the communication port 106 and the communication port 107, as illustrated in FIG. 13. The communication port 106 is an opening that opens toward the inside of the second air chamber 186. The communication port 107 is an opening that opens toward the inside of the storage section 181. The second air chamber 186 passes from the communication port 106 via the second communicating passage 187 through the communication port 107 to the storage section 181. By the above, the storage section 181 passes via the second communicating passage 187, the second air chamber 186, the first communicating passage 185, the first air chamber 184, and the air communication port 115 to the exterior of the tank 9B. This means that the communicating section 183 establishes communication between the air communication port 115 and the storage section 181. The air that has flowed in from the air communication port 115 into the first air chamber 184 flows into the second air chamber 186 via the first communicating passage 185. Then, the air that has flowed into the second air chamber 186 flows in to the inside of the storage section 181 via the second communicating passage 187.

As illustrated in FIG. 14, in the case 171, a recess 206 is provided to the side of the sixth wall 86 opposite to the recess 202 side. The recess 206 and the recess 202 are lined up sandwiching the sixth wall 86 in the X-axis direction. The recess 206 is provided at an orientation so as to be concave going toward the side opposite to the sheet member 63 (FIG. 12) side. The recess 206 is provided to inside the groove 117. The recess 206 can also be regarded as being a configuration with which the depth at a part of the groove 117 is increased. When the sheet member 63 is bonded to the case 171, the groove 117 is closed off by the sheet member 63, thus constituting the second communicating passage 187, as illustrated in FIG. 13. Then, in the second communicating passage 187, the recess 206 is constituted as a buffer chamber 188. Herein, the cross-sectional area of the buffer chamber 188 in the horizontal direction (the XY plane) is wider than the cross-sectional area of the second communicating passage 187 in the horizontal direction (the XY plane). The cross-sectional area of the buffer chamber 188 in the horizontal direction (the XY plane) is narrower than the cross-sectional area of the second air chamber 186 in the horizontal direction (the XY plane).

Figure 15:
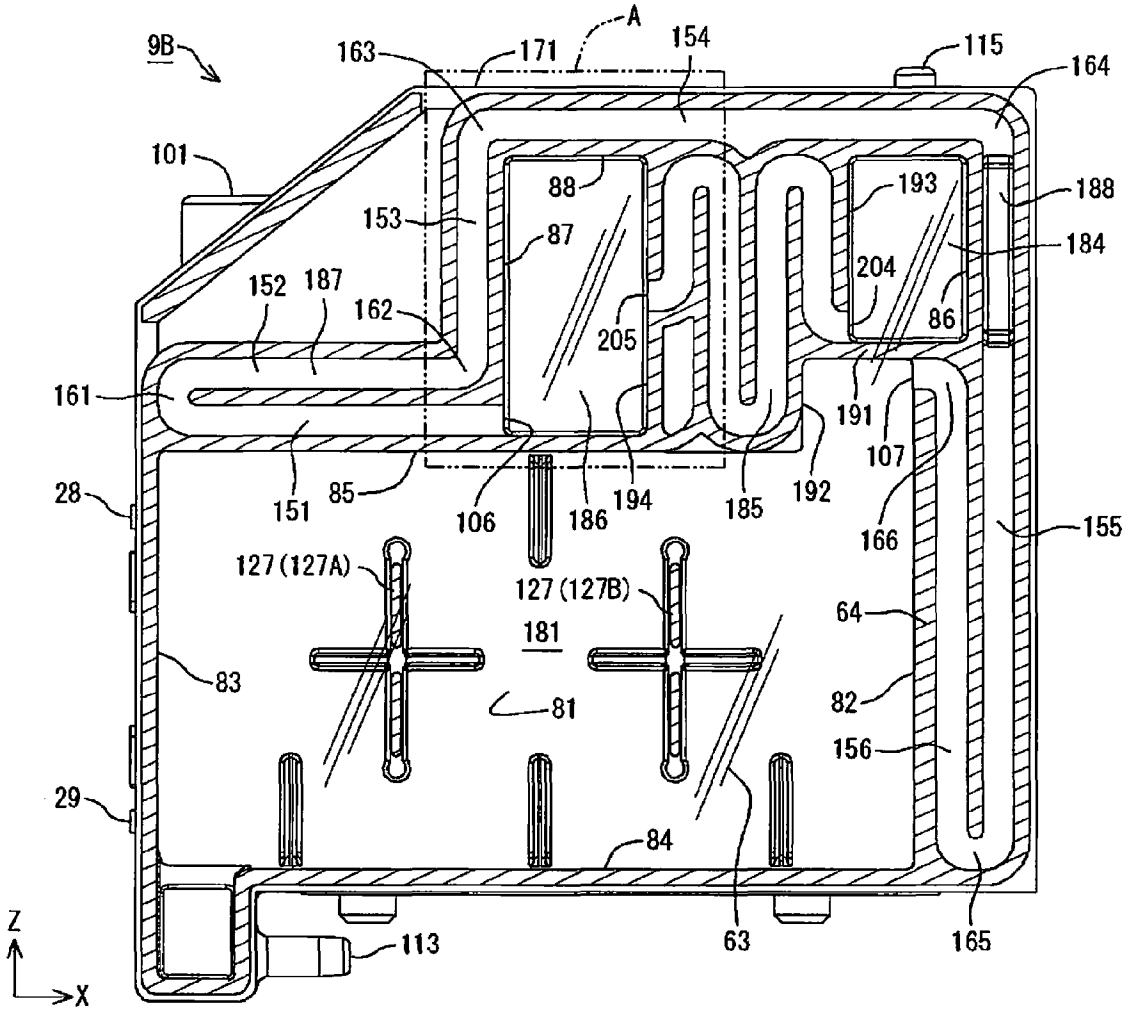
FIG. 15 is a side view of when a tank in the second embodiment is viewed from a sheet member side.

In the tank 9B, as well, as with the first embodiment, the sheet member 63 is bonded to the bonding sections 64 at each of the two support sections 127. In the tank 9B, as well, as with the first embodiment, the gap between the third wall 83 and the support section 127A, the gap between the support section 127A and the support section 127B, and the gap between the second wall 82 and the support section 127B are set so as to be equal to one another. Also, in the tank 9B, as well, as with the first embodiment, the second communicating passage 187, as illustrated in FIG. 15, can be sectioned into the first passage 151, the second passage 152, the third passage 153, the fourth passage 154, the fifth passage 155, and the sixth passage 156. Also, in the tank 9B, as well, as with the first embodiment, the orientation of the flow path is reversed at each of the reversal section 161 and the reversal section 165. At each of the bend section 162, the bend section 163, and the bend section 164, the orientation of the flow path is bent.

Also, in the tank 9B, as well, as with the first embodiment, the buffer chamber 188 is located above the fifth wall 85 in the Z-axis direction. For this reason, in the tank 9B, as well, as with the first embodiment, the buffer chamber 188 is located above the opening 128 (FIG. 7) of the ink injection section 101. Moreover, as with the first embodiment, in order to easily avoid the event where the buffer chamber 188 ends up being filled with the ink, it suffices for at least a part of the buffer chamber 188 to be located above the opening 128 in the Z-axis direction. In this configuration, it is still possible to make it easier to avoid the event where the buffer chamber 188 ends up being filled with the ink.

The buffer chamber 188 is provided to the fifth passage 155 in the second communicating passage 187. The buffer chamber 188 is arranged between the ninth wall 191 and the eighth wall 88 in the Z-axis direction. The place of arrangement of the buffer chamber 188 is not limited to being the fifth passage 155. Any of the sites of the first passage 151 through sixth passage 156 could also be employed as the place of arrangement of the buffer chamber 188. Furthermore, any of the sites of the reversal section 161, the reversal section 165, the bend section 162, the bend section 163, the bend section 164, and the bend section 166 could also be employed as the place of arrangement of the buffer chamber 188.

In the tank 9B, the communication port 106 is located at the intersection at which the seventh wall 87 and the fifth wall 85 intersect together. In another viewpoint, the communication port 106 is located at the lower end of the second air chamber 186 in the vertical direction. The communication port 107 is located at the intersection at which the second wall 82 and the ninth wall 191 intersect together. In another viewpoint, the communication port 107 is located at the upper end of the storage section 181 in the vertical direction. In the present embodiment, the communication port 107 is located below the buffer chamber 188 in the vertical direction. The communication port 204 is located at the intersection at which the ninth wall 191 and the eleventh wall 193 intersect together. In another viewpoint, the communication port 204 is located at the lower end of the first air chamber 184 in the vertical direction.

As with the first embodiment, the communication port 107 is located above the upper limit mark 28 in the vertical direction, as illustrated in FIG. 13. The upper limit mark 28 is located below the fifth wall 85 in the vertical direction. For this reason, the upper limit mark 28 is located below the opening 128 of the ink injection section 101 in the vertical direction. This makes it easier to avoid an event where ink would surpass the upper limit mark 28 and arrive at the opening 128 when the worker is injecting the ink into the tank 9B from the ink injection section 101. For this reason, it is easier to avoid an event where the ink overflows from the ink injection section 101 when the worker is injecting the ink into the tank 9B from the ink injection section 101.

As stated above, the ninth wall 191 is located on the side opposite to the storage section 181 side more than the fifth wall 85. In other words, the ninth wall 191 is located above the fifth wall 85 in the Z-axis direction. Then, the communication port 107 is located at the intersection at which the second wall 82 and the ninth wall 191 intersect together. For this reason, the communication port 107 is located above the fifth wall 85 in the Z-axis direction. Herein, the opening 128 (FIG. 7) of the ink injection section 101 is provided to the fifth wall 85, as in the first embodiment. Accordingly, the communication port 107 is located above the opening 128 (FIG. 7) in the Z-axis direction.

Figure 16:
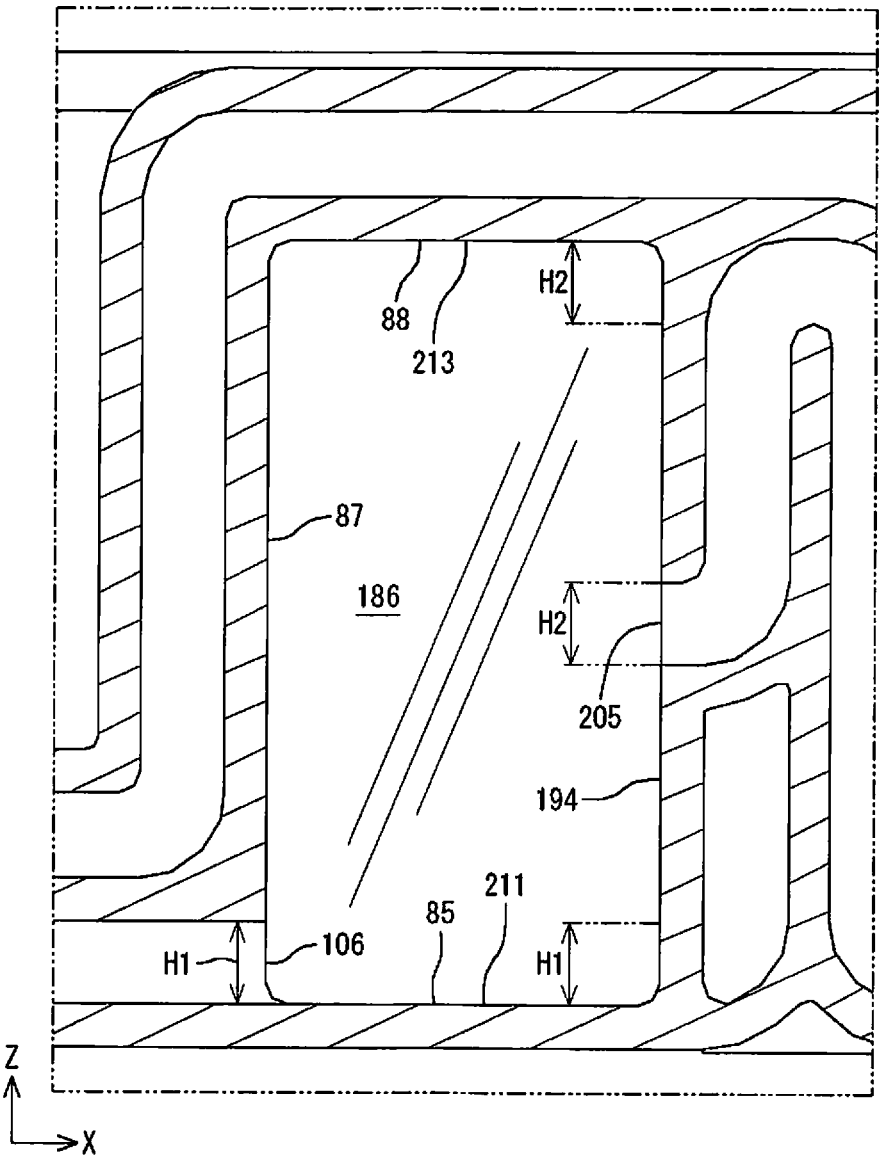
FIG. 16 is an enlarged view of the A section in FIG. 15.

The communication port 205 is located to the eighth wall 88 side more than the intersection at which the fifth wall 85 and the twelfth wall 194 intersect together, as illustrated in FIG. 16, which is an enlarged view of the A section in FIG. 15. In another viewpoint, the communication port 205 is located above a lower end 211 of the second air chamber 186 in the vertical direction. Moreover, in the tank 9B, the communication port 205 is located to the fifth wall 85 side more than the intersection at which the eighth wall 88 and the twelfth wall 194 intersect together. In another viewpoint, the communication port 205 is located below an upper end 213 of the second air chamber 186 in the vertical direction.

In the present embodiment, the communication port 205 is located above a position that is raised by a distance H1 from the lower end 211. The dimension H1 is a dimension of the communication port 106 in the Z-axis direction. The communication port 205 is also located below a position that has been lowered by a dimension H2 from the upper end 213. The dimension H2 is a dimension of the communication port 205 in the Z-axis direction.

In the second embodiment, the Z-axis direction corresponds to a direction intersecting with the horizontal direction, the storage section 181 corresponds to a liquid storage section, the ink injection section 101 corresponds to a liquid injection section, the opening 128 corresponds to a liquid injection port, the second air chamber 186 corresponds to an air chamber, and the communication port 107 corresponds to a connecting port. The air communication port 115, the first air chamber 184, and the first communicating passage 185 correspond to an air introduction system. The second communicating passage 187 corresponds to a communicating passage and the case 171 corresponds to a case member. The second wall 82 and the third wall 83 correspond to two inner walls that face one another across ribs. One among either the third passage 153 or the fifth passage 155 corresponds to a first portion and the other among the third passage 153 and the fifth passage 155 corresponds to a second portion.

In the second embodiment, effects similar to those of the first embodiment are also obtained. In the second embodiment, as stated above, the communication port 205 is located above the lower end 211 of the second air chamber 186 (FIG. 16). For this reason, when, for example, ink has flowed in from the storage section 181 to inside the second air chamber 186 via the second communicating passage 187, it is easy to avoid an event where the ink that has flowed into the second air chamber 186 ends up directly arriving at the communication port 205. In other words, the ink that has flowed in from the storage section 181 to inside the second air chamber 186 via the second communicating passage 187 is readily stopped inside the second air chamber 186. As a result of this, it is easy to even further avoid an event where the ink inside the storage section 181 leaks out from the air communication port 115 to the outside of the tank 9B.

Also, in the second embodiment, as stated above, the communication port 205 is located below the upper end 213 of the second air chamber 186 (FIG. 16). For this reason, when the vertical orientation of the tank 9B is inverted in a state where, for example, ink has flowed in from the storage section 181 to inside the second air chamber 186 via the second communicating passage 187, then it is easy to avoid an event where the ink inside the second air chamber 186 would arrive directly at the communication port 205. In other words, even in a state where the vertical orientation of the tank 9B has been inverted, the ink that has flowed in from the storage section 181 to inside the second air chamber 186 via the second communicating passage 187 is readily stopped inside the second air chamber 186. As a result of this, it is easy to even further avoid an event where the ink inside the storage section 181 leaks out from the air communication port 115 to the outside of the tank 9B.

Further, in the second embodiment, as stated above, the communication port 205 is located above the position that is raised by the dimension H1 from the lower end 211. According to this configuration, when, for example, ink has flowed in from the storage section 181 to inside the second air chamber 186 via the second communicating passage 187, it is easy to avoid an event where the ink that has flowed into the second air chamber 186 ends up moving along the fifth wall 85 from the communication port 106 and directly arriving at the communication port 205. In other words, the ink that has flowed in from the storage section 181 to inside the second air chamber 186 via the second communicating passage 187 is readily stopped inside the second air chamber 186. As a result of this, it is easy to even further avoid an event where the ink inside the storage section 181 leaks out from the air communication port 115 to the outside of the tank 9B.

Also, in the second embodiment, as stated above, the communication port 205 is located below the position that is lowered by the dimension H2 from the upper end 213. According to this configuration, when the vertical orientation of the tank 9B is inverted in a state where, for example, ink has flowed in from the storage section 181 to inside the second air chamber 186 via the second communicating passage 187, it is easy to avoid an event where the ink inside the second air chamber 186 ends up directly arriving at the communication port 205. In other words, even in a state where the vertical orientation of the tank 9B has been inverted, the ink that has flowed in from the storage section 181 to inside the second air chamber 186 via the second communicating passage 187 is readily stopped inside the second air chamber 186. As a result of this, it is easy to even further avoid an event where the ink inside the storage section 181 leaks out from the air communication port 115 to the outside of the tank 9B.

Figure 17:
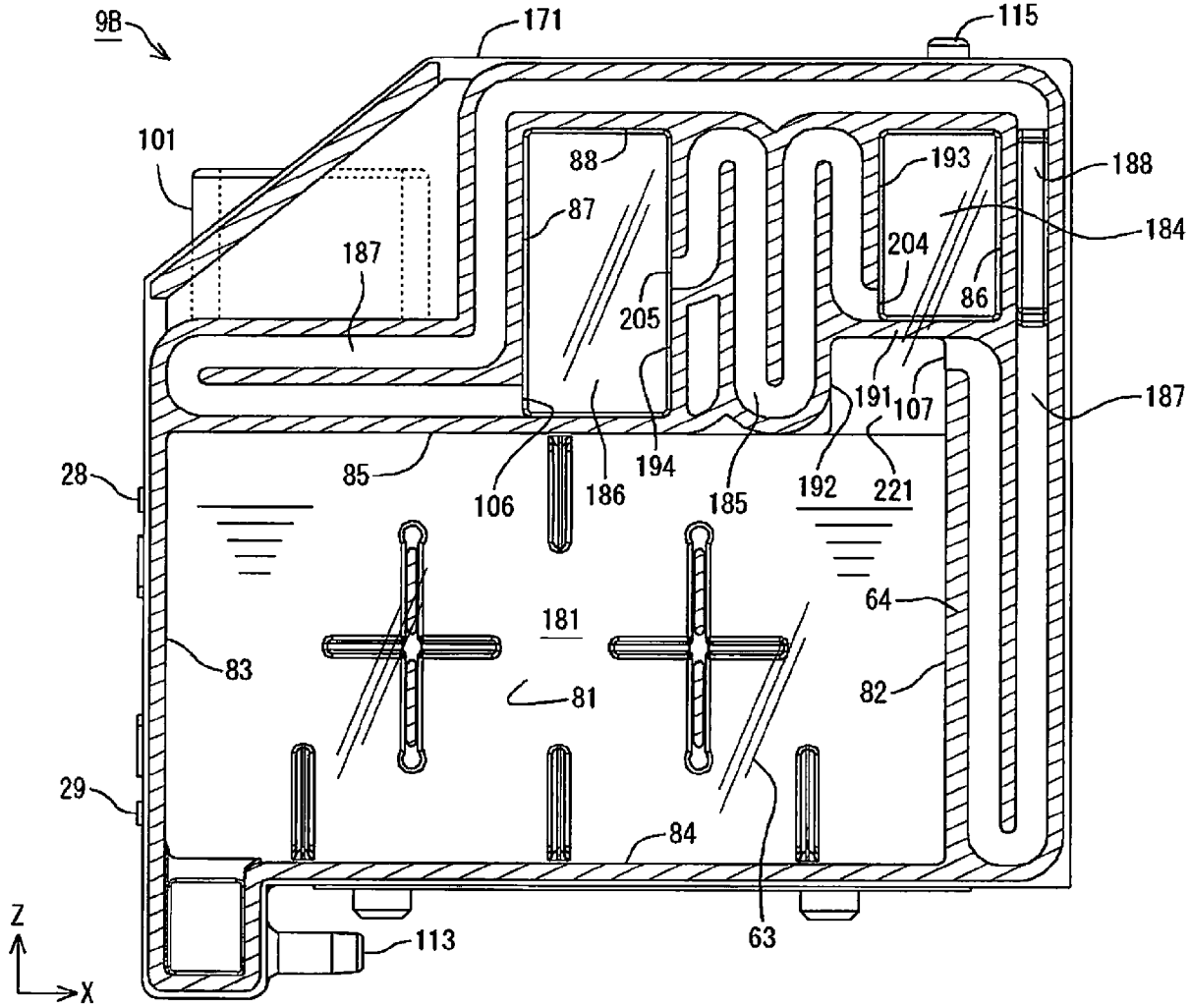
FIG. 17 is a side view of when a tank in the second embodiment is viewed from a sheet member side.

In the second embodiment, the ninth wall 191 is located to the eighth wall 88 side more than the fifth wall 85, as illustrated in FIG. 17. In another viewpoint, the ninth wall 191 is located vertically above the fifth wall 85. In other words, the height of the ninth wall 191 from the fourth wall 84 is greater than the height of the fifth wall 85 from the fourth wall 84. The tenth wall 192 is provided between the ninth wall 191 and the fifth wall 85. This configuration causes a recess 221 to be configured in the storage section 181. The recess 221 is provided at an orientation so as to be concave going toward the eighth wall 88 side more than the fifth wall 85, i.e., going toward the +Z-axis direction side more than the fifth wall 85. In the recess 221, the communication port 107 is provided to a position that faces the tenth wall 192. For this reason, the communication port 107 is located to the ninth wall 191 side more than the fifth wall 85. In another viewpoint, the communication port 107 is located vertically above the fifth wall 85. In the second embodiment, the recess 221 corresponds to an upper region.

As stated above, the opening 128 (FIG. 7) of the ink injection section 101 is provided to the fifth wall 85, as in the first embodiment. For this reason, the communication port 107 is located above the opening 128 (FIG. 7) in the Z-axis direction. According to this configuration, the ink inside the storage section 181 will less readily arrive at the communication port 107. For this reason, the possibility that the ink inside the storage section 181 could flow in to inside the second communicating passage 187 is reduced. As a result, the possibility that the ink inside the storage section 181 could arrive at the second air chamber 186 can be reduced, and therefore the possibility that the ink inside the storage section 181 could leak out of the tank 9B from the second air chamber 186 via the first communicating passage 185 and the first air chamber 184 can be reduced.

Figure 18:
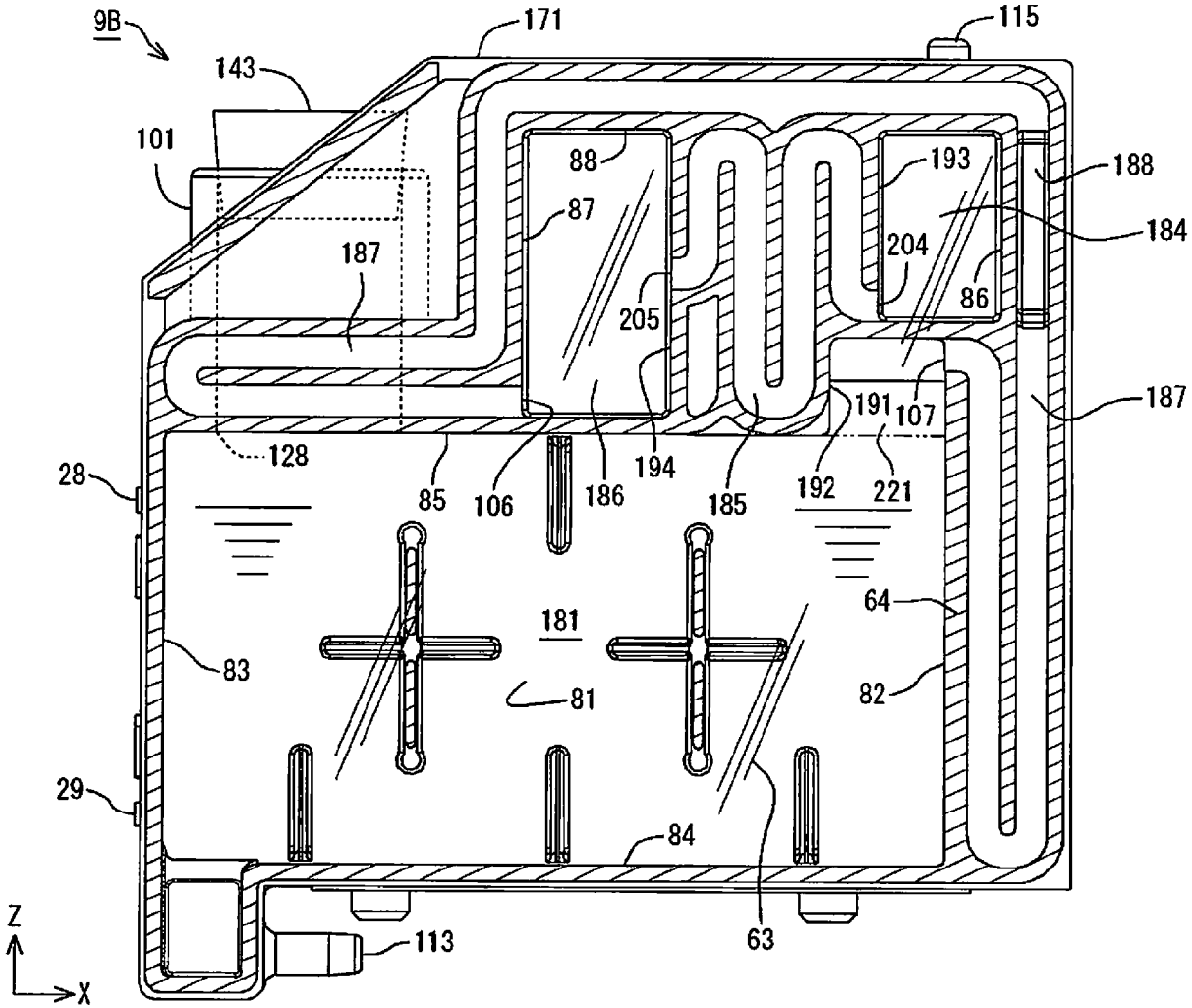
FIG. 18 a side view of when a tank in the second embodiment is viewed from a sheet member side.

Moreover, as illustrated in, for example, FIG. 17, it is conceivable that when the ink is being injected from the ink injection section 101, the liquid level of the ink inside the tank 9B could end up reaching the fifth wall 85. When the liquid level of the ink reaches the fifth wall 85, then the ink reaches the opening 128 of the ink injection section 101. In the tank 9B, even in such a case, the air space is still maintained in the recess 221. When the cap 143 is implemented after injection, as illustrated in FIG. 18, then it is believed that there will be higher pressure inside the storage section 181 and the liquid level of the ink will rise in the recess 221. In the tank 9B, the air space is still present in the recess 221 even when such an event occurs, and therefore, the risen liquid surface will less readily arrive at the communication port 107. For this reason, compared to the first embodiment, it is easy to even further prevent the ink inside the storage section 181 from flowing in from the communication port 107 to inside the second communicating passage 187. As a result of this, it is easy to even further avoid an event where the ink inside the storage section 181 leaks out from the air communication port 115 to the outside of the tank 9B.

In the present embodiment, the volume of the recess 221 is greater than the volume, out of the space surrounded by the side wall 129 of the ink injection section 101, into which the cap 143 is fitted. This makes it possible, even though the cap 143 may be mounted in a state where the space that is surrounded by the side wall 129 is filled to capacity with ink, to use the volume of the recess 221 to capture the amount of ink that is pushed into the storage section 181 by the cap 143. As a result of this, even though the space that is surrounded by the side wall 129 may be filled to capacity with ink, the ink inside the storage section 181 will less readily reach the communication port 107. Accordingly, it is easy to even further prevent the ink inside the storage section 181 from flowing into the second communicating passage 187 from the communication port 107. As a result of this, it is easy to even further avoid an event where the ink inside the storage section 181 leaks out from the air communication port 115 to the outside of the tank 9B.

The embodiment described above illustrates an example where the tank 9B is constituted of the case 171 and the sheet member 63, but the configuration of the tank 9B is not limited thereto. An example where, for example, the case 171 is constituted of a plurality members could also be employed as the configuration of the tank 9B. Examples where the case 171 is constituted of a plurality of members include an example where the first wall 81 of the case 171 is constituted of another member. Further, examples where the first wall 81 of the case 171 is constituted of another member include an example where the first wall 81 is constituted of a sheet member different from the sheet member 63. This example would be a configuration where the case 171 is sandwiched between the sheet member 63 and the other sheet member. The tank 9B can be configured by this configuration, as well.

In the second embodiment described above, as well, as with the first embodiment, the configuration where the slop 168 illustrated in FIGS. 11A and 11B has been added to the buffer chamber 188 could also be employed. According to this configuration, as with the first embodiment, the amount of ink that remains in the buffer chamber 188 can also be further reduced, and therefore waste of the ink can be even further mitigated.

In each of the embodiments above, the plurality of tanks 9 are not built into the first case 3, which covers the mechanism unit 10. In other words, each of the embodiments above employs a configuration where the plurality of tanks 9 are arranged on the outside of the first case 3. A configuration where the plurality of tanks 9 are built into the first case 3, however, could also be employed. Below, a configuration where the plurality of tanks 9 are built into the case shall be described, using the example of a multifunction peripheral, which is one example of a liquid jet apparatus.

Figure 19:
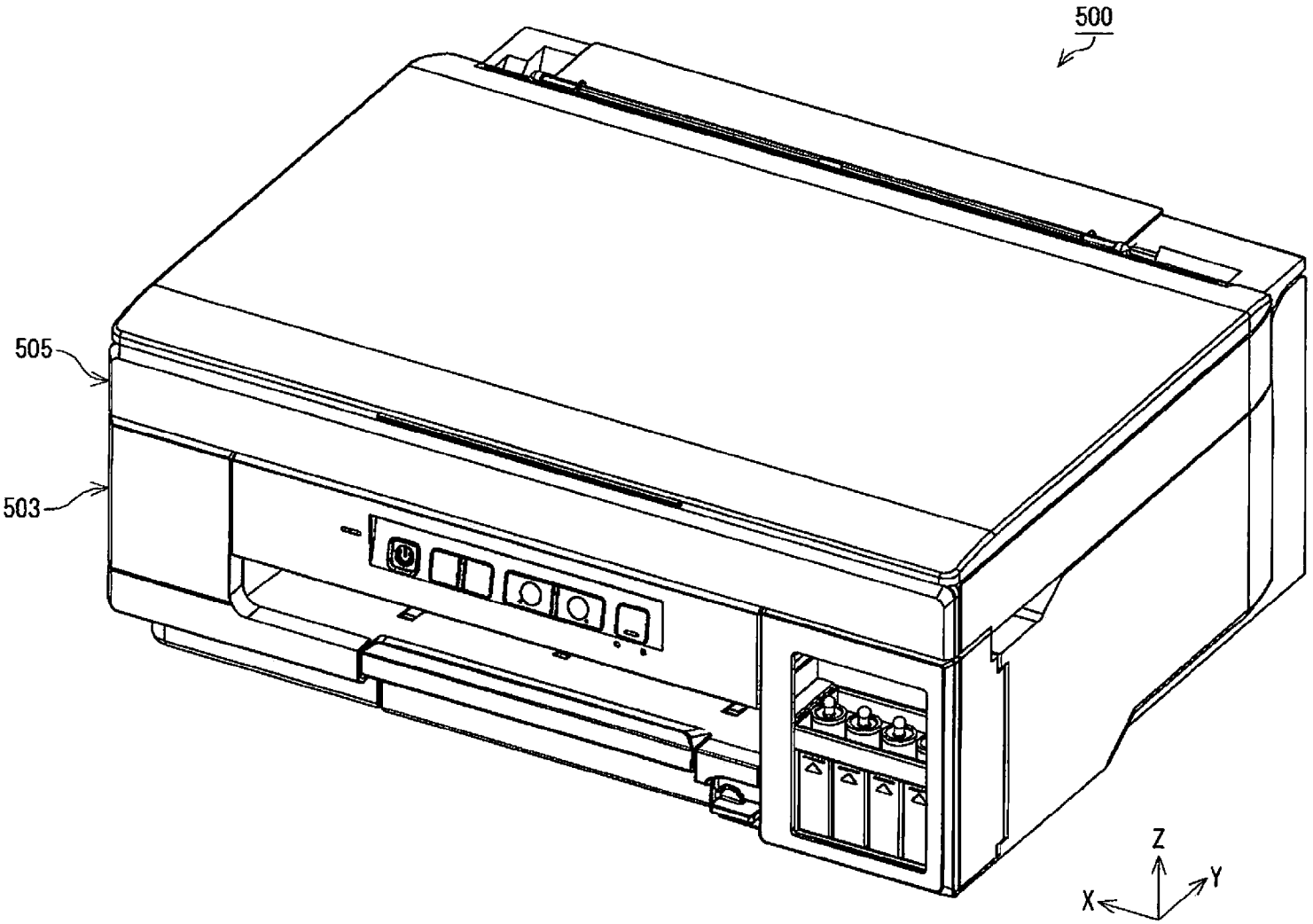
FIG. 19 is a perspective view illustrating a multifunction peripheral in the present embodiments.

A multifunction peripheral 500 in the present embodiment has a printer 503 and a scanner unit 505, as illustrated in FIG. 19. In the multifunction peripheral 500, the printer 503 and the scanner unit 505 are stacked onto one another. In the state where the printer 503 is used, the scanner unit 505 is located vertically above the printer 503. Here, in FIG. 19, XYZ axes have been assigned, which are coordinate axes that are orthogonal to one another. XYZ axes have been assigned where necessary in the subsequently illustrated drawings, as well. The XYZ axes in FIG. 19 confirm with the XYZ axes in FIG. 1, as do the XYZ axes in FIG. 19 and onward. In the multifunction peripheral 500, configurations that are similar to the printer 1 are assigned the same reference numerals as in the printer 1 and a detailed description thereof is omitted.

Figure 20:
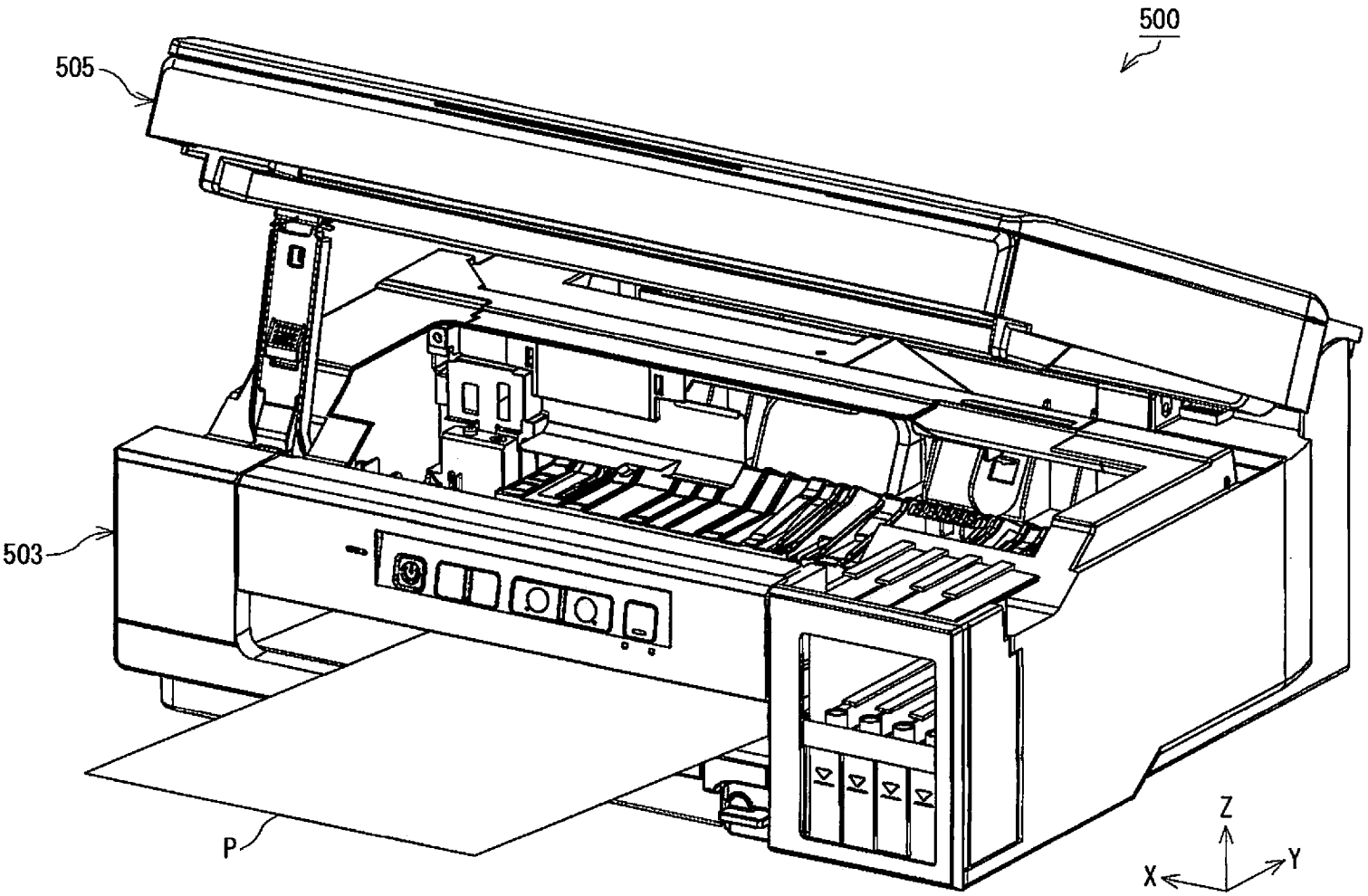
FIG. 20 is a perspective view illustrating a multifunction peripheral in the present embodiments.

The scanner unit 505 is of the flatbed-type, and has an imaging element (not shown) such as an image sensor, as well as a platen and a covering. Via the imaging element, the scanner unit 505 is able to read an image that has been recorded onto a medium such as paper, as image data. For this reason, the scanner unit 505 functions as an apparatus for reading images and the like. The scanner unit 505 is configured so as to be rotatable relative to a case 507 of the printer 503, as illustrated in FIG. 20. A surface on the printer 503 side of the platen of the scanner unit 505 covers the case 507 of the printer 503 and also has a function as a covering for the printer 503.

Figure 21:
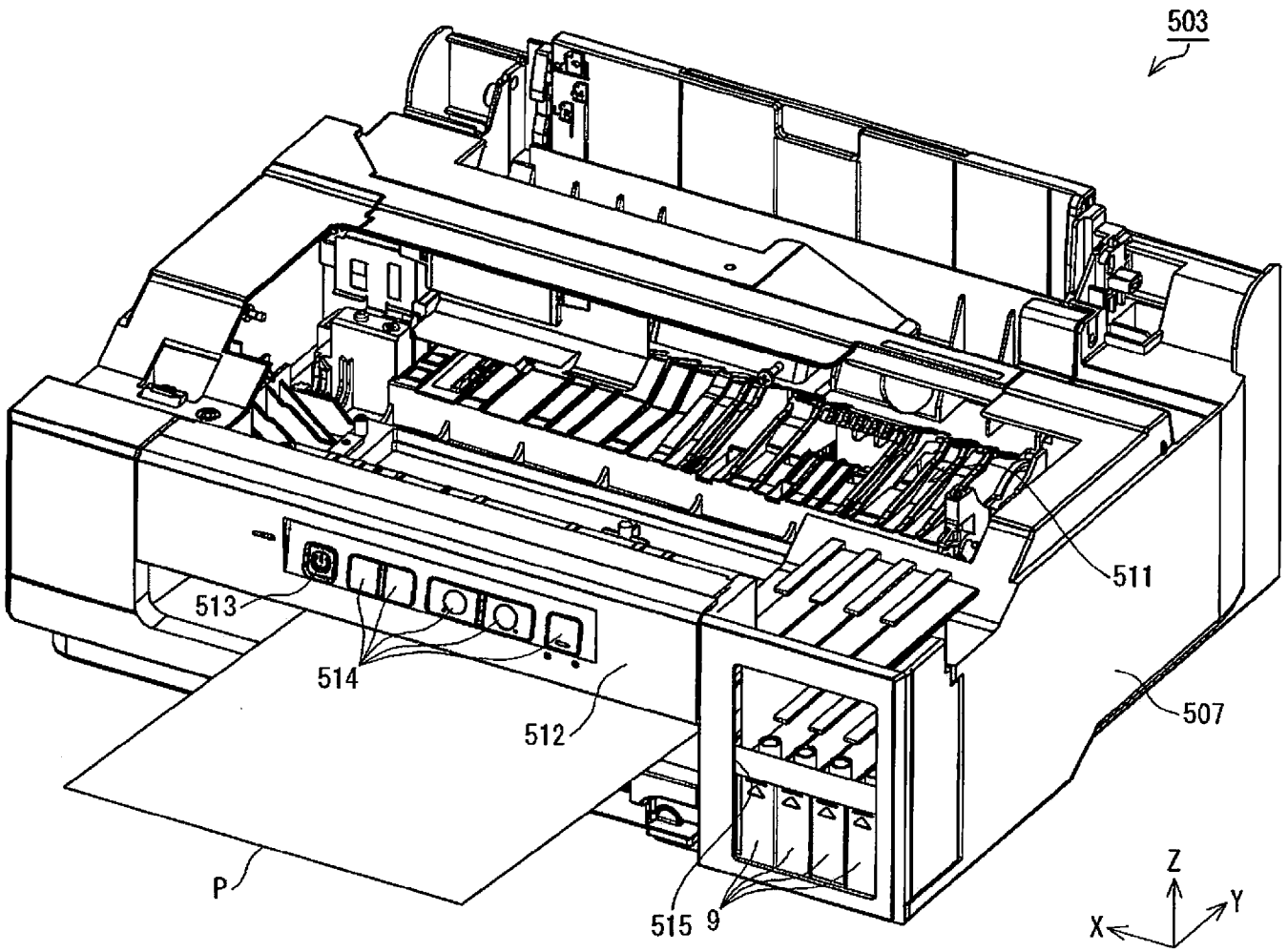
FIG. 21 is a perspective view illustrating a printer in the present embodiments.

The printer 503 is able to print onto the printing medium P of printing paper or the like using ink, which is one example of a liquid. The printer 503, as illustrated in FIG. 21, has the case 507 as well as the plurality of tanks 9, which are one example of a liquid storage container. The case 507 is an integrally formed article constituting an outer shell of the printer 503, and houses a mechanism unit 511 of the printer 503. The plurality of tanks 9 are stored inside the case 507, and each of the plurality of tanks 9 stores ink that is supplied for printing. In the printer 503, there are four of the tanks 9 provided. The four tanks 9 have different types of ink from one another. The four types of black, yellow, magenta, and cyan are employed as the types of ink in the printer 503. There is one tank 9 provided for each of the different kinds of ink.

The printer 503 also has an operation panel 512. Provided to the operation panel 512 are a power source button 513, another operation button 514, and the like. The worker who operates the printer 503 can face the operation panel 512 and in this state operate the power source button 513 or the operation button 514. In the printer 503, the surface to which the operation panel 512 is provided is understood to be the front surface. On the front surface of the printer 503, a window section 515 is provided to the case 507. The window section 515 is optically transparent. The four tanks 9 described above are provided to positions overlapping with the window section 515. For this reason, the worker is able to view the four tanks 9 through the window section 515.

In the printer 503, the sites of each of the tanks 9 that face the window section 515 are optically transparent. The inks inside the tanks 9 can be viewed from the optically transparent sites of each of the tanks 9. As such, viewing the four tanks 9 via the window section 515 allows the worker to view the amount of ink that is in each of the tanks 9. In the printer 503, because the window section 515 is provided to the front surface of the printer 503, the operator can face the operation panel 512 and in this state view each of the tanks 9 from the window section 515. For this reason, the worker can ascertain the amount of ink remaining in each of the tanks 9 while also operating the printer 503.

Figure 22:
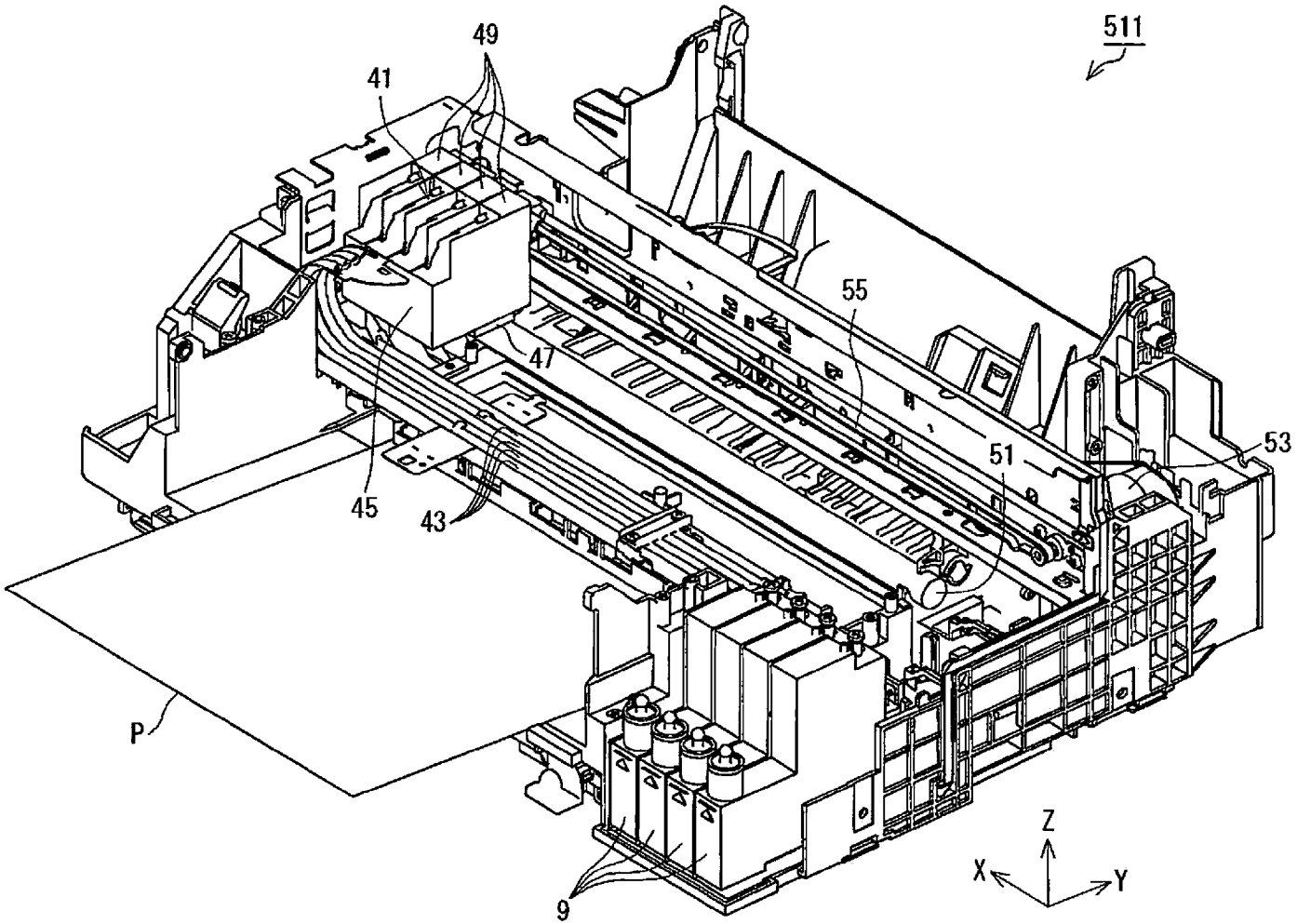
FIG. 22 is a perspective view illustrating a mechanism unit of a printer in the present embodiments.

The printer 503 has the print section 41 and the supply tubes 43, as illustrated in FIG. 22, which is a perspective view illustrating the mechanism unit 511. The print section 41 and the supply tubes 43 have configurations similar to those of the print section 41 and supply tubes 43 in the printer 1, respectively. In the printer 503, as well, as with the printer 1, the medium conveyance mechanism conveys the printing medium P along the Y-axis direction by driving the conveyance roller 51 using power coming from the motor 53 (not shown). In the printer 503, as well, as in the printer 1, the head conveyance mechanism conveys the carriage 45 along the X-axis direction by transmitting power coming from the motor 53 to the carriage 45 via the timing belt 55. The print head 47 is mounted onto the carriage 45. For this reason, the print head 47 can be conveyed in the X-axis direction via the carriage 45, by the head conveyance mechanism. The inks are discharged from the print head 47 while the relative position of the print head 47 with respect to the printing medium P is being changed by the medium conveyance mechanism and the head conveyance mechanism, whereby printing is performed on the printing medium P.

In each of the embodiments described above, the liquid jet apparatus may be a liquid jet apparatus that consumes a liquid other than an ink by ejecting, discharging, or coating with the liquid. A liquid that trails with particles, tears, or threads is also understood to be included as a state of a liquid that is made into minute liquid droplets and discharged from the liquid jet apparatus. It suffices for the liquid as referred to herein to be such a material that can be consumed with a liquid jet apparatus. For example, it suffices for the liquid to be a substance when the substance is in the liquid phase, and high- or low-viscosity liquids, sols, gel waters, and other inorganic solvents, organic solvents, solutions, liquid resins, liquid metals (molten metals), and other liquid bodies are understood to be included. Not only liquids in the form of one state of a substance, but also solvents into which a functional material composed of a solid matter such as a pigment or metal particles has been dissolved or dispersed, or the like are also understood to be included. Representative examples of liquids could include an ink such as was described in the embodiments above, a liquid crystal, or the like. Herein, the term "ink" encompasses a variety of compositions in the form of a liquid, such as general water-soluble inks and oil-soluble inks as well as gel inks, hot melt inks, and the like. Other specific examples of the liquid jet apparatus may include a liquid jet apparatus for ejecting a liquid containing, in the form of a dispersion or solution, a material such as an electrode material or color material that is used, inter alia, in the manufacture of liquid crystal displays, electroluminescence (EL) displays, surface emitting displays, or color filters. Other examples may include a liquid jet apparatus for ejecting a biological organic matter used to manufacture biochips; a liquid jet apparatus for ejecting a liquid serving as a sample, used as a precision pipette; or printing device, a micro-dispenser, or the like. Further examples include: a liquid jet apparatus for ejecting a lubricant at pin points for a precision machine such as a timepiece or camera; or a liquid jet apparatus for ejecting a transparent resin solution such as an ultraviolet curable resin onto a substrate in order to form, inter alia, a hemispherical micro lens (optical lens) used in an optical communication element or the like. Another example may be a liquid jet apparatus for ejecting an acid or alkali etching solution in order to etch a substrate or the like.

A liquid storage container as described above includes a side wall surrounding the liquid injection port and projecting out toward the outside of the liquid storage section, and a cap configured to blocking off the liquid injection port, the liquid storage section including an upper region that is located above the liquid injection port in the posture, the connecting port being provided to the upper region, and a volume of the upper region being greater than a volume of the cap that is fitted to the side wall.

In this embodiment, the volume of the upper region is greater than the volume of the cap that is fitted to the side wall, and therefore even when the cap is fitted to the side wall in a state where, for example, the inside of the side wall has been filled with the liquid, the liquid that is pressed against the inside of the liquid storage section with the cap can still be collected in the upper region. This causes the liquid inside the liquid storage section to less readily reach the connecting port even in a configuration having a cap, and therefore makes it possible to reduce the possibility that that liquid inside the liquid storage section could leak out of the liquid storage container via the air introduction section from the air chamber.

A liquid storage container according to the embodiment includes a liquid storage section configured to store a liquid, a liquid injection section configured to inject the liquid into the liquid storage section, an air chamber communicated with air, an air introduction section communicated to the air chamber and configured to introduce the air to the air chamber, a communicating passage through which the liquid storage section and the air chamber are communicated to each other, at least a part of the liquid storage section being optically transmissive, the at least a part of the liquid storage section having a mark indicating an upper limit for an amount of the liquid, a liquid injection port defined as an intersection at which the liquid injection section and the liquid storage section intersect each other, and a connecting port defined between the liquid storage section and the communicating passage and located above the mark in a posture where a liquid injection port is oriented upward in a direction intersecting with a horizontal direction.

With the liquid storage container of this embodiment, the connecting port between the liquid storage section and the communicating passage is located above the mark indicating the upper limit for the amount of the liquid, and therefore the liquid inside the liquid storage section is less likely to reach the connecting port. For this reason, the possibility that the liquid inside the liquid storage section could flow into the communicating passage is reduced. As a result, the possibility that the liquid inside the liquid storage section could reach the air chamber is reduced, and therefore the possibility that the liquid inside the liquid storage section could leak out of the liquid storage container via the air introduction section from the air chamber can be reduced.

A liquid storage container as described above further includes a case member having a groove and a recess communicating with the groove, and a sheet member covering the groove and the recess to seal the groove and the recess, at least a part of the communicating passage being formed of a space surrounded by the groove and the sheet member, and at least a part of the liquid storage section being formed of a space surrounded by the recess and the sheet member.

In this embodiment, at least a part of the communicating passage can be configured with the case member and the sheet member, as can at least a part of the liquid storage section.

A liquid storage container as described above is characterized in that a rib that is convex toward the sheet member is provided inside the recess.

In this embodiment, the rib is provided inside the recess and therefore it is easy to use the rib to regulate deformation of the sheet member when the sheet member is deformed toward inside the recess.

A liquid storage container as described above is characterized in that the sheet member is bonded to the rib.

In this embodiment, the sheet member is bonded to the rib and therefore deformation of the sheet member to the side opposite to the case member side is easily regulated.

A liquid storage container as described above is characterized in that the recess has two inner walls that face one another across the rib, and a gap between the rib and one inner wall of the two inner walls is equal to a gap between the rib and the other inner wall of the two inner walls.

In this embodiment, deformation of the sheet member is easily regulated equally between the rib and one inner wall and between the rib and the other inner wall.

A liquid storage container as described above is characterized in that the recess has two inner walls that face one another, a plurality of the ribs are provided inside the recess and are lined up along a direction in which the two inner walls face one another, and a gap between one inner wall of the two inner walls and the rib that is adjacent to the one inner wall in the direction, a gap between the other inner wall of the two inner walls and the rib that is adjacent to the other inner wall in the direction, and a gap of two of the ribs that are adjacent in the direction are all equal to one another.

In this embodiment, deformation of the sheet member is easily regulated mutually equally between one inner wall and a rib adjacent to this inner wall, between the other inner wall and a rib adjacent to this inner wall, and between two ribs that are adjacent to one another.

A liquid storage container as described above is characterized in that the air chamber is located above the liquid storage section and a part of the communicating passage is located above the air chamber in the posture.

In this embodiment, the air chamber is located above the liquid storage section and a part of the communicating passage is located above the air chamber, and therefore the liquid that has flowed into the communicating passage from the liquid storage section will less readily rise above the air chamber, due to the action of gravity. For this reason, liquid that has flowed into the communicating passage from the liquid storage section will less readily arrive at the air chamber. As a result, it is easier to prevent liquid that has flowed from the liquid storage section into the communicating passage from leaking out from the liquid storage container.

A liquid storage container as described above is characterized in that the communicating passage includes a first portion and a second portion, and the first portion and the second portion are located at opposite sides to one another across the air chamber in the horizontal direction in the posture.

In this embodiment, the route of the communicating passage can be lengthened by putting the space surrounding the air chamber to use and forming the communicating passage so as to run around the air chamber.

A liquid jet apparatus according to the embodiment includes a first case, a mechanism unit including a mechanism portion covered by the first case and configured to execute a print operation, a second case coupled to the first case, and a plurality of liquid storage containers. The plurality of liquid storage containers are covered by the second case and are arranged to supply a liquid to a print section of the mechanism unit via supply tubes.

In the liquid jet apparatus of this embodiment, the plurality of liquid storage containers are arranged inside the same second case, and therefore any variance such as in the height of the connecting port between the liquid storage section and the communicating passage in the plurality of liquid storage containers can be reduced. As a result of this, even in a case where a plurality of liquid storage containers are used, it is possible to endow all of the liquid storage containers with the effect of reducing the possibility that the liquid could leak out of the liquid storage containers via the air introduction sections.

A liquid jet apparatus according to the embodiment includes a case, a mechanism unit including a mechanism portion covered by the case and configured to execute a print operation, and a plurality of liquid storage containers. The plurality of liquid storage containers are covered by the case and are arranged to supply a liquid to a print section of the mechanism unit via supply tubes.

In the liquid jet apparatus of this embodiment, the plurality of liquid storage containers are arranged inside the same case, and therefore any variance such as in the height of the connecting port between the liquid storage section and the communicating passage in the plurality of liquid storage containers can be reduced. As a result of this, even in a case where a plurality of liquid storage containers are used, it is possible to endow all of the liquid storage containers with the effect of reducing the possibility that the liquid could leak out of the liquid storage containers via the air introduction sections.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only a selected embodiment has been chosen to illustrate the present invention, it will be apparent to those skilled in the art from this disclosure that various changes and modifications can be made herein without departing from the scope of the invention as defined in the appended claims. Furthermore, the foregoing descriptions of the embodiment according to the present invention are provided for illustration only, and not for the purpose of limiting the invention as defined by the appended claims and their equivalents.

What is claimed is:

1. A liquid storage container comprising:

a liquid storage section configured to store a liquid;

a liquid injection section connected to the liquid storage section and configured to inject the liquid into the liquid storage section;

an air communication port communicating with the air;

a communicating passage through which the air communication port and the liquid storage section are communicated to each other; and a liquid injection port defined as an intersection at which the liquid injection section and the liquid storage section intersect each other; and a connecting port defined between the liquid storage section and the communicating passage and located above the liquid injection port in a use state that supplies the liquid, wherein the liquid injection section includes a side wall projecting out toward the outside of the liquid storage section, the liquid storage container further comprises a cap configured to be inserted from an opposite side opposite to a liquid injection port-side into a space surrounded with the side wall and configured to block off the liquid injection section, the liquid storage section includes an upper region that is located above the liquid injection section in the using state, the connecting port is provided in the upper region, and the upper region has a volume greater than a volume of a portion of the space in which the cap is inserted.

2. The liquid storage container according to claim 1, further comprising a first wall, a second wall arranged to intersect with the first wall, a third wall arranged to intersect the first wall and to face the second wall, a fourth wall arranged to intersect with each of the first wall, the second wall and the third wall, a fifth wall arranged to intersect with each of the first wall and the second wall, and to face the fourth wall, a seventh wall arranged to intersect with the fifth wall and to be protruded from the first wall and from the fifth wall in a direction opposite to the fourth wall, and an eighth wall arranged to intersect with the seventh wall and to be protruded from the first wall, wherein the liquid injection section is provided between the third wall and the seventh wall, and on the fifth wall, and the air communication port is provided on the eighth wall.

3. The liquid storage container according to claim 1, wherein at least apart of the liquid storage section is optically transmissive, the at least a part of the liquid storage section has a mark indicating an amount of the liquid remaining in the liquid storage section, and a communication port connecting the liquid storage section with the communicating passage is located above the mark in the use state.

4. The liquid storage container according to claim 1, further comprising a case member having a groove and a recess communicating with the groove, and a sheet member covering the groove and the recess to seal the groove and the recess, wherein at least a part of the communicating passage is formed of a space surrounded by the groove and the sheet member, and at least a part of the liquid storage section is formed of a space surrounded by the recess and the sheet member.

5. The liquid storage container according to claim 4, wherein a rib that is convex toward the sheet member is provided inside the recess.

6. The liquid storage container according to claim 5, wherein the sheet member is bonded to the rib.

7. The liquid storage container according to claim 5, wherein the recess has two inner walls that face one another across the rib, and a gap between the rib and one inner wall of the two inner walls is equal to a gap between the rib and the other inner wall of the two inner walls.

8. The liquid storage container according to claim 5, wherein the recess has two inner walls that face one another, a plurality of the ribs are provided inside the recess and are lined up along a direction in which the two inner walls face one another, and a gap between one inner wall of the two inner walls and the rib that is adjacent to the one inner wall in the direction, a gap between the other inner wall of the two inner walls and the rib that is adjacent to the other inner wall in the direction, and a gap of two of the ribs that are adjacent in the direction are all equal to one another.

* * * * *